US012523393B2

(12) United States Patent
Joo et al.

(10) Patent No.: US 12,523,393 B2
(45) Date of Patent: Jan. 13, 2026

(54) AIR CONDITIONER AND CONTROLLING METHOD THEREOF TO DRY WATER CONDENSED ON A SURFACE OF A HEAT EXCHANGER

(71) Applicant: SAMSUNG ELECTRONICS CO., LTD., Suwon-si (KR)

(72) Inventors: Youngju Joo, Suwon-si (KR); Taewoo Kim, Suwon-si (KR); Seungjun Park, Suwon-si (KR); Jeonguk Park, Suwon-si (KR); Hyeongjoon Seo, Suwon-si (KR); Hyoshin Lee, Suwon-si (KR); Hyeongkyu Cho, Suwon-si (KR); Hyoungseo Choi, Suwon-si (KR); Jun Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 522 days.

(21) Appl. No.: 17/993,546

(22) Filed: Nov. 23, 2022

(65) Prior Publication Data

US 2023/0093074 A1 Mar. 23, 2023

Related U.S. Application Data

(63) Continuation of application No. PCT/KR2021/006140, filed on May 17, 2021.

(30) Foreign Application Priority Data

Jul. 13, 2020 (KR) ..... 10-2020-0086225

(51) Int. Cl.
*F24F 13/22* (2006.01)
*F24F 1/0014* (2019.01)
(Continued)

(52) U.S. Cl.
CPC ..... *F24F 13/222* (2013.01); *F24F 1/0014* (2013.01); *F24F 11/61* (2018.01);
(Continued)

(58) Field of Classification Search
CPC ..... F24F 13/222; F24F 1/0014; F24F 11/61; F24F 11/84; F24F 11/86; F24F 2013/225;
(Continued)

(56) References Cited

U.S. PATENT DOCUMENTS 11,137,148 B2 10/2021 Choi et al.
2010/0170295 A1* 7/2010 Okazaki ..... F04C 23/001 418/55.1
(Continued)

FOREIGN PATENT DOCUMENTS

JP 11-211184 8/1999
JP 11-223376 8/1999
(Continued)

OTHER PUBLICATIONS

International Search Report dated Sep. 1, 2021 issued in PCT/KR2021/006140.
(Continued)

*Primary Examiner* — Alicia M. Choi
(74) *Attorney, Agent, or Firm* — STAAS & HALSEY LLP

(57) ABSTRACT

An air conditioner including a heat exchanger; a blower fan; a compressor; and a controller. The controller performs: a cooling process in which the compressor is operated to compress a circulating refrigerant, the heat exchanger performs heat exchange between the refrigerant and air, and the blowing fan is operated to blow air to the heat exchanger. The controller performs a drying process including: performing, a blowing process in which the blower fan is operated to blow air to the heat exchanger while the com-
(Continued)

pressor is stopped, and performing a heating process in which the refrigerant is circulated in a direction that is changed from that of the cooling process, the blower fan is operated to blow air to the heat exchanger, and the compressor is operated to compress the refrigerant, thereby heating the surface of the heat exchanger and drying water condensed on the surface of the heat exchanger.

12 Claims, 20 Drawing Sheets

(51) Int. Cl.
*F24F 11/61* (2018.01)
*F24F 11/84* (2018.01)
*F24F 11/86* (2018.01)
*F24F 120/10* (2018.01)
*F24F 140/20* (2018.01)

(52) U.S. Cl.
CPC ..... *F24F 11/84* (2018.01); *F24F 11/86* (2018.01); *F24F 2013/225* (2013.01); *F24F 2120/10* (2018.01); *F24F 2140/20* (2018.01)

(58) Field of Classification Search
CPC .... F24F 2120/10; F24F 2140/20; F24F 11/56; F24F 11/63; F24F 11/65; F24F 11/48; F24F 13/082; F24F 11/79; F24F 11/30; F24F 11/42; F25B 5/02; F25B 2600/2513; F25B 47/00; F25B 13/00; G06N 3/02; H04L 12/28; H04L 12/2816; Y02B 30/70
See application file for complete search history.

(56) References Cited

U.S. PATENT DOCUMENTS

| | | | | |
|---|---|---|---|---|
| 2015/0167999 | A1* | 6/2015 | Seem | F24F 11/64 700/276 |
| 2017/0023264 | A1* | 1/2017 | Ha | F24F 11/46 |
| 2017/0356661 | A1* | 12/2017 | Fischer | F24F 3/153 |
| 2019/0271483 | A1 | 9/2019 | Joo et al. | |
| 2020/0240668 | A1* | 7/2020 | Bassa | F24F 11/0001 |
| 2021/0131681 | A1* | 5/2021 | Duncan | B01D 53/265 |
| 2023/0101146 | A1* | 3/2023 | Hamada | F24F 11/86 700/278 |

FOREIGN PATENT DOCUMENTS

| | | | | |
|---|---|---|---|---|
| JP | 2001-41542 | | | 2/2001 |
| JP | 2003-14334 | | | 1/2003 |
| JP | 2003-329290 | | | 11/2003 |
| JP | 2009-58143 | | | 3/2009 |
| JP | 4697260 | | | 6/2011 |
| JP | 2011-220608 | | | 11/2011 |
| JP | 2011220608 | A | * | 11/2011 |
| JP | 2012-220032 | | | 11/2012 |
| JP | 2016-65687 | | | 4/2016 |
| JP | 2017-198420 | | | 11/2017 |
| JP | 2018-169079 | | | 11/2018 |
| JP | 2018200127 | A | * | 12/2018 |
| JP | 2019-39669 | | | 3/2019 |
| JP | 6641066 | | | 2/2020 |
| JP | 3 611 446 | B1 | | 5/2022 |
| KR | 10-2008-0064017 | | | 7/2008 |
| KR | 10-2008-0064537 | | | 7/2008 |
| KR | 20080064537 | A | * | 7/2008 |
| KR | 10-2016-0050298 | | | 5/2016 |
| KR | 10-2016-0087565 | | | 7/2016 |
| KR | 10-2018-0044160 | | | 5/2018 |
| KR | 10-2018-0059128 | | | 6/2018 |
| KR | 10-2018-0071031 | | | 6/2018 |
| KR | 10-2018-0138068 | | | 12/2018 |
| KR | 10-2019-0072023 | | | 6/2019 |
| KR | 10-2019-0109640 | | | 9/2019 |
| KR | 10-2019-0110405 | | | 9/2019 |
| KR | 10-2019-0125088 | | | 11/2019 |
| KR | 10-2086581 | | | 3/2020 |
| KR | 10-2020-0088609 | | | 7/2020 |
| WO | WO-2020144797 | A1 | * | 7/2020 |

OTHER PUBLICATIONS

Written Opinion dated Sep. 1, 2022 issued in Application No. PCT/KR2021/006140.

Office Action dated Nov. 12, 2024, in Korean Application No. 10-2020-0086225.

Office Action dated May 8, 2025, in Korean Patent Application No. 10-2020-0086225.

* cited by examiner

| DRYING PROCESS (HEATING PROCESS) | |
|---|---|
| BLOWER FAN (100) OF INDOOR UNIT (1B) | ON |
| BLOWER FAN (167) OF INDOOR UNIT (1C) | OFF |
| BLOWER FAN (162) OF INDOOR UNIT (1A) | ON |

AIR CONDITIONER AND CONTROLLING METHOD THEREOF TO DRY WATER CONDENSED ON A SURFACE OF A HEAT EXCHANGER

CROSS-REFERENCE TO RELATED APPLICATIONS

This application is a continuation application, under 35 U.S.C. § 111(a), of International Patent Application No. PCT/KR2021/006140, filed on May 17, 2021, which is based on and claims priority under 35 U.S.C. § 119 to Korean Patent Application No. 10-2020-0086225, filed on Jul. 13, 2020, at the Korean Intellectual Property Office, the disclosures all of which are hereby incorporated by reference herein in its their entireties.

BACKGROUND

1. Field

The present disclosure relates to an air conditioner for performing a drying process of drying the inside, and a control method thereof.

2. Description of Related Art

In general, an air conditioner is an appliance for cooling or heating air by transferring heat generated by evaporation and condensation of a refrigerant and discharging the cooled or heated air to air-condition an inside space.

The air conditioner circulates, during a cooling process or a heating process, a refrigerant and sucks room air by rotating a fan around an indoor heat exchanger. Also, the air conditioner performs heat-exchange of the sucked air in the indoor heat exchanger and discharges the air to an indoor space.

Also, the air conditioner performs a drying process after a cooling process terminates to remove water condensed in the indoor heat exchanger during the cooling process. The air conditioner evaporates the water condensed in the indoor heat exchanger by stopping circulating the refrigerant and rotating the fan around the indoor heat exchanger during the drying process. However, at high absolute humidity, there are difficulties in completely evaporating water condensed on the indoor heat exchanger only by blowing through a rotation of the fan.

SUMMARY

An air conditioner according to an embodiment includes: a heat exchanger; a blower fan; a compressor; and a controller configured to: perform a cooling process in which the compressor is operated to compress a circulating refrigerant, the heat exchanger performs heat exchange between the refrigerant and air, and the blowing fan is operated to blow air to the heat exchanger, thereby cooling a space; after termination of the cooling process, perform a drying process to dry water condensed on a surface of the heat exchanger and not removed during the cooling process, the drying process including: performing, for a first predetermined time, a blowing process in which the blower fan is operated to blow air to the heat exchanger while the compressor is stopped, thereby drying at least some of the water condensed on the surface of the heat exchanger, and after the first predetermined time, performing a heating process in which the refrigerant is circulated in a direction that is changed from that of the cooling process, the blower fan is operated to blow air to the heat exchanger, and the compressor is operated to compress the refrigerant, thereby heating the surface of the heat exchanger and drying water on the surface of the heat exchanger not dried by the cooling process.

The air conditioner may further include a temperature sensor configured to detect a condensation temperature of the refrigerant, wherein the controller may be further configured to terminate the heating process in a case in which a preset time elapses after the heating process starts or in a case in which the condensation temperature is higher than or equal to target condensation temperature.

The controller may be further configured to terminate the heating process; and after the heating process terminates, operate the compressor for a second predetermined time thereby evaporating the refrigerant in the heat exchanger.

The compressor may be operated for the second predetermined time after elapse of a third predetermined time after the heating process terminates, and the air conditioner may further include a 4-way valve configured to change the circulating direction of the, wherein the controller may be further configured to, after elapse of the third predetermined time, operate the 4-way valve to change the circulating direction of the refrigerant to that of the cooling process.

The drying process may be initiated by a user, and the air conditioner may further include an inputter configured to receive a command for initiating the drying process from a user, wherein the controller may be further configured to, after the inputter receives the command for initiating the drying process, perform a dehumidifying process in which the compressor is operated to compress the circulating refrigerant, the heat exchanger performs heat exchange between the refrigerant and air, and the blowing fan is operated to blow air to the heat exchanger, thereby generating the water to be condensed on the surface of the heat exchanger; terminate the dehumidifying process; and after the dehumidifying process terminates, perform the drying process.

The controller may be further configured to, after the dehumidifying process terminates and before the drying process begins, perform a freezing process in which the compressor is operated to compress the circulating refrigerant, the heat exchanger performs heat exchange between the refrigerant and air, the blowing fan is operated to blow air to the heat exchanger, and the target condensation temperature of the refrigerant is lowered, thereby freezing the water condensed on the surface of the heat exchanger.

The drying process may include raising the target condensation temperature before the heating process.

The air conditioner may further include a sensor configured to detect whether an occupant is in the space, wherein the controller may be further configured to perform the drying process based on a detection that there is no occupant in the space.

The air conditioner may further include a communicator configured to communicate with an access point (AP) and a terminal; wherein the controller may be further configured to perform the drying process based on information received from the communicator indicating that there is no occupant in the space.

The controller may be further configured to identify a time at which it is expected that no occupant will be in the space, and perform the drying process at the identified time, wherein the time at which it is expected that no occupant will be in the space is identified based on an output from a trained neural network that is trained using at least one of the time at which a command for initiating the drying process is received from a user, and a time at which it is identified that no occupant is in the space based on information received from the communicator.

The heat exchanger and the blower fan may be included in an indoor unit, and the air conditioner may further include at least a first and second indoor unit, wherein the controller may be further configured to independently control the blower fan of each indoor unit such that during the heating process, the controller stops the blower fan of the first indoor unit while the controller operates the blowing fan of at least the second indoor unit.

The air condition may further include an expansion valve configured to control the opening of a refrigerant flow path, and the controller may be further configured to open the expansion valve of a refrigerant flow path connected to the first indoor unit by a preset ratio during the heating process.

The air conditioner may further include an outlet; and an outlet panel on a front surface of the outlet, the outlet panel including a plurality of holes, wherein the controller may be further configured to perform a control operation of discharging air through the plurality of holes during the drying process.

A method, according to an embodiment, includes an air conditioner including a heat exchanger, a blower fan a compressor, and a controller, the method including, by the controller: performing a cooling process in which the compressor is operated to compress a circulating refrigerant, the heat exchanger performs heat exchange between the refrigerant and air, and the blowing fan is operated to blow air to the heat exchanger, thereby cooling a space; after termination of the cooling process, performing a drying process to dry water condensed on a surface of the heat exchanger and not removed during the cooling process, the drying process including: performing, for a predetermined time, a blowing process in which the blower fan is operated to blow air to the heat exchanger while the compressor is stopped, thereby drying at least some of the water condensed on the surface of the heat exchanger, and after the predetermined time, performing a heating process in which the refrigerant is circulated in a direction that is changed from that of the cooling process, the blower fan is operated to blow air to the heat exchanger, and the compressor is operated to compress the refrigerant, thereby heating the surface of the heat exchanger and drying water on the surface of the heat exchanger not dried by the cooling process.

The air conditioner may further include a temperature sensor configured to detect a condensation temperature of the refrigerant, and the method may further include, by the controller, terminating the heating process in a case in which a first time elapses after the heating process starts, or in a case in which the condensation temperature is detected to be higher than or equal to a target condensation temperature.

BRIEF DESCRIPTION OF THE DRAWINGS

Aspects, features, and advantages of certain embodiments of the present disclosure will be more apparent from the following description taken in conjunction with the accompanying drawings, in which.

DETAILED DESCRIPTION

Figure 1:
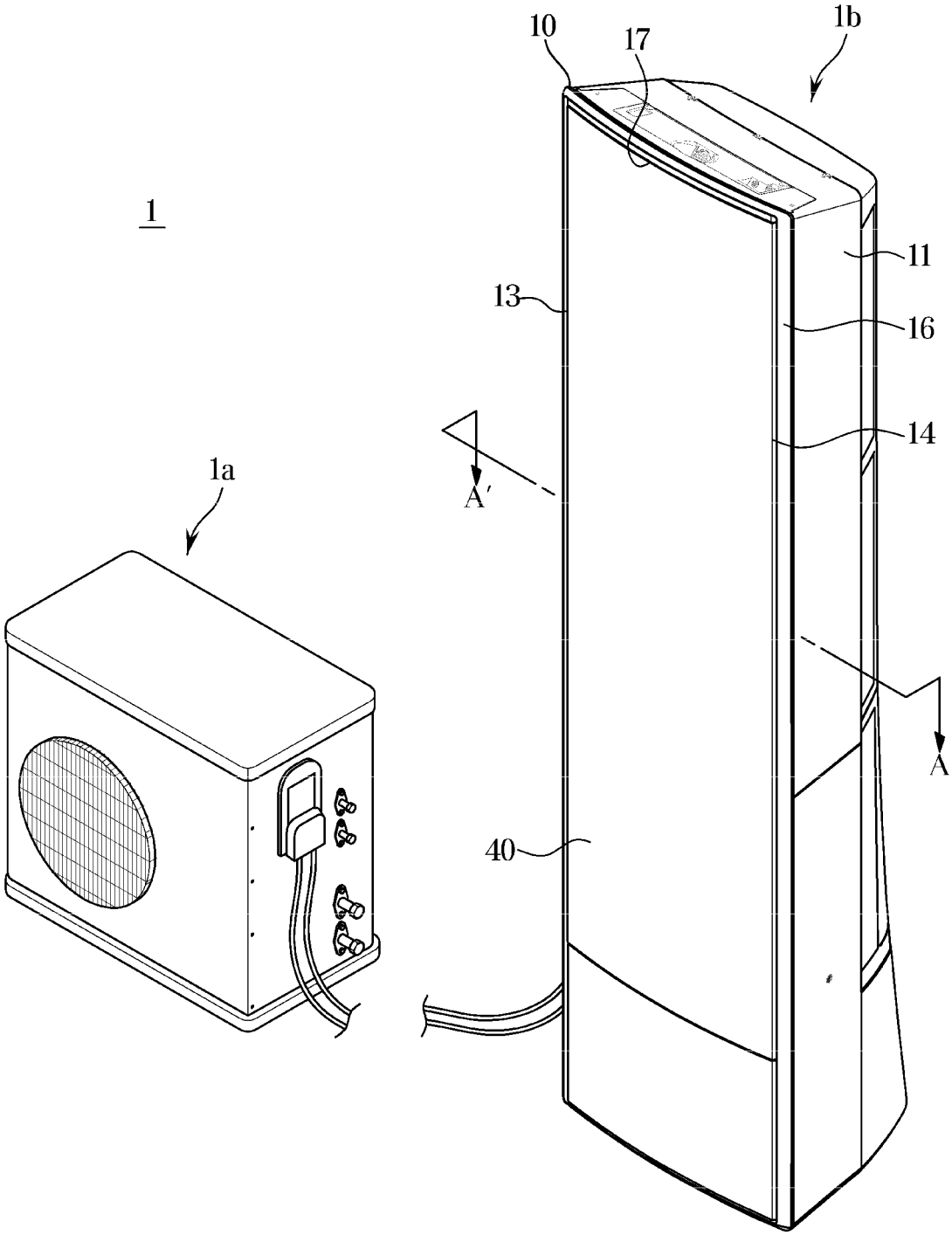
FIG. 1 shows an outer appearance of an air conditioner according to an embodiment.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

In the entire specification, it will be understood that when a certain part is referred to as being "connected" to another part, it can be directly or indirectly connected to the other part. When a part is indirectly connected to another part, it may be connected to the other part through a wireless communication network.

Also, the terms used in the present specification are merely used to describe embodiments, and are not intended to limit and/or restrict the disclosure. An expression used in the singular encompasses the expression of the plural, unless it has a clearly different meaning in the context. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure.

In addition, the terms "portion", "device", "block", "member", and "module" used herein refer to a unit for processing at least one function or operation. For example, the terms may mean at least one process that may be processed by at least one hardware such as field-programmable gate array (FPGA) or application specific integrated circuit (ASIC), or at least one software or processor stored in a memory.

Reference numerals used in operations are provided to identify the operations, without describing the order of the operations, and the operations can be executed in a different order from the stated order unless a specific order is definitely specified in the context.

Disclosed herein are an air conditioner and method capable of completely drying water condensed on an indoor heat exchanger while preventing heat from diffusing to an indoor space by performing a heating process of discharging heat-exchanged air through a plurality of holes at low speed during a drying process.

Hereinafter, an embodiment of the disclosure will be described in detail with reference to the accompanying drawings.

Figure 2:
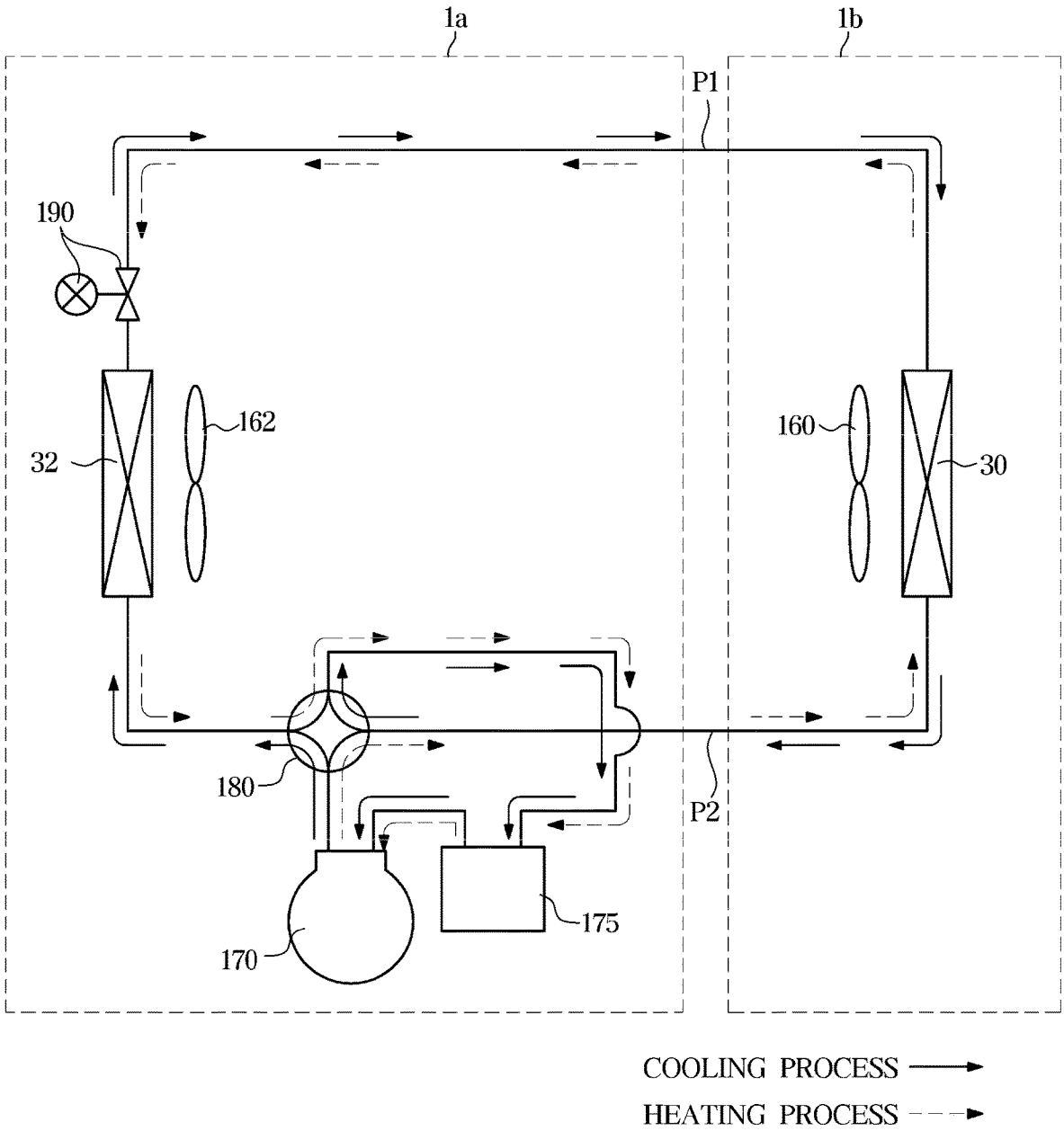
FIG. 2 shows components related to a flow of a refrigerant in an air conditioner according to an embodiment.
Figure 3:
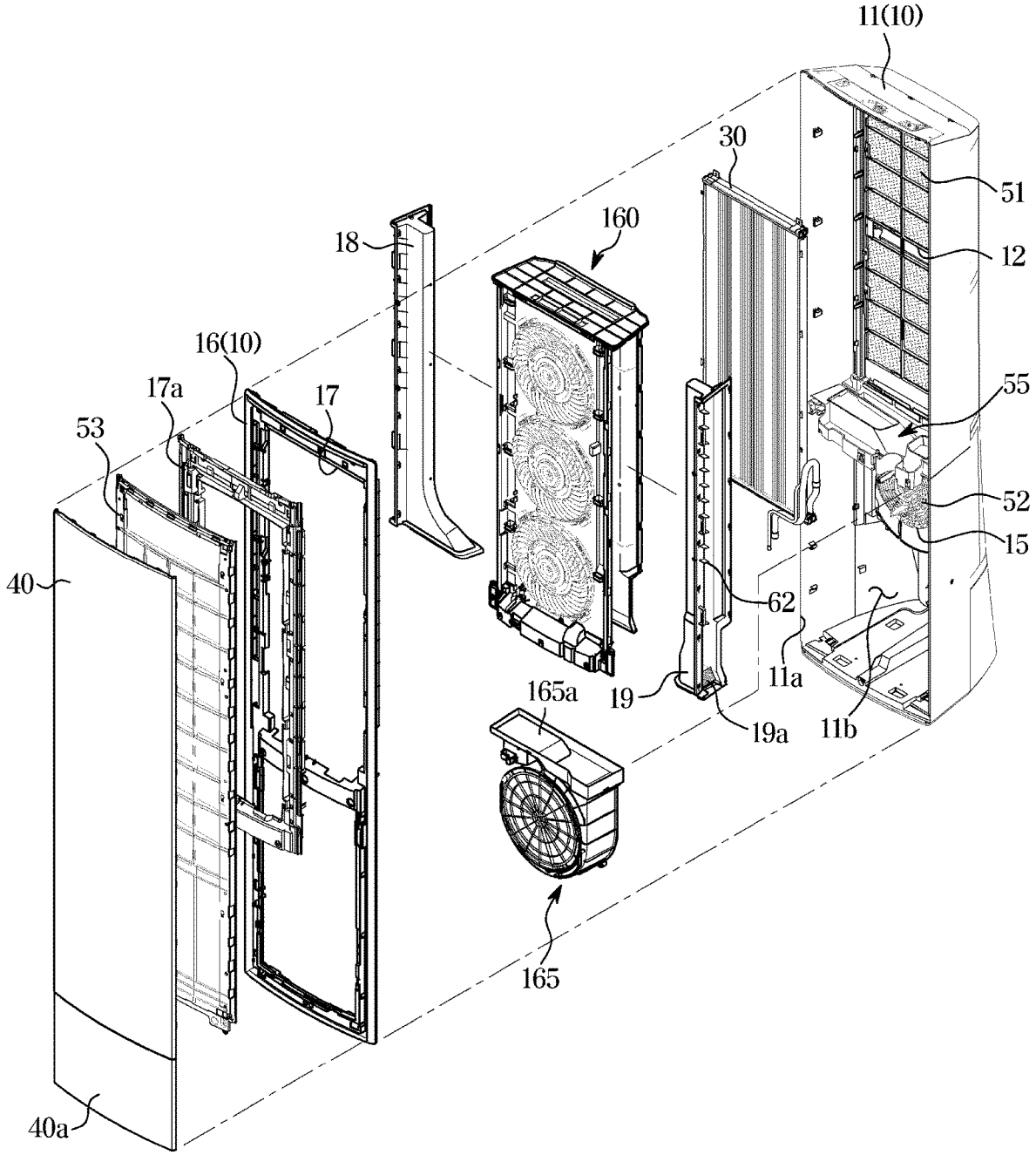
FIG. 3 is an exploded view of an air conditioner according to an embodiment.
Figure 4:
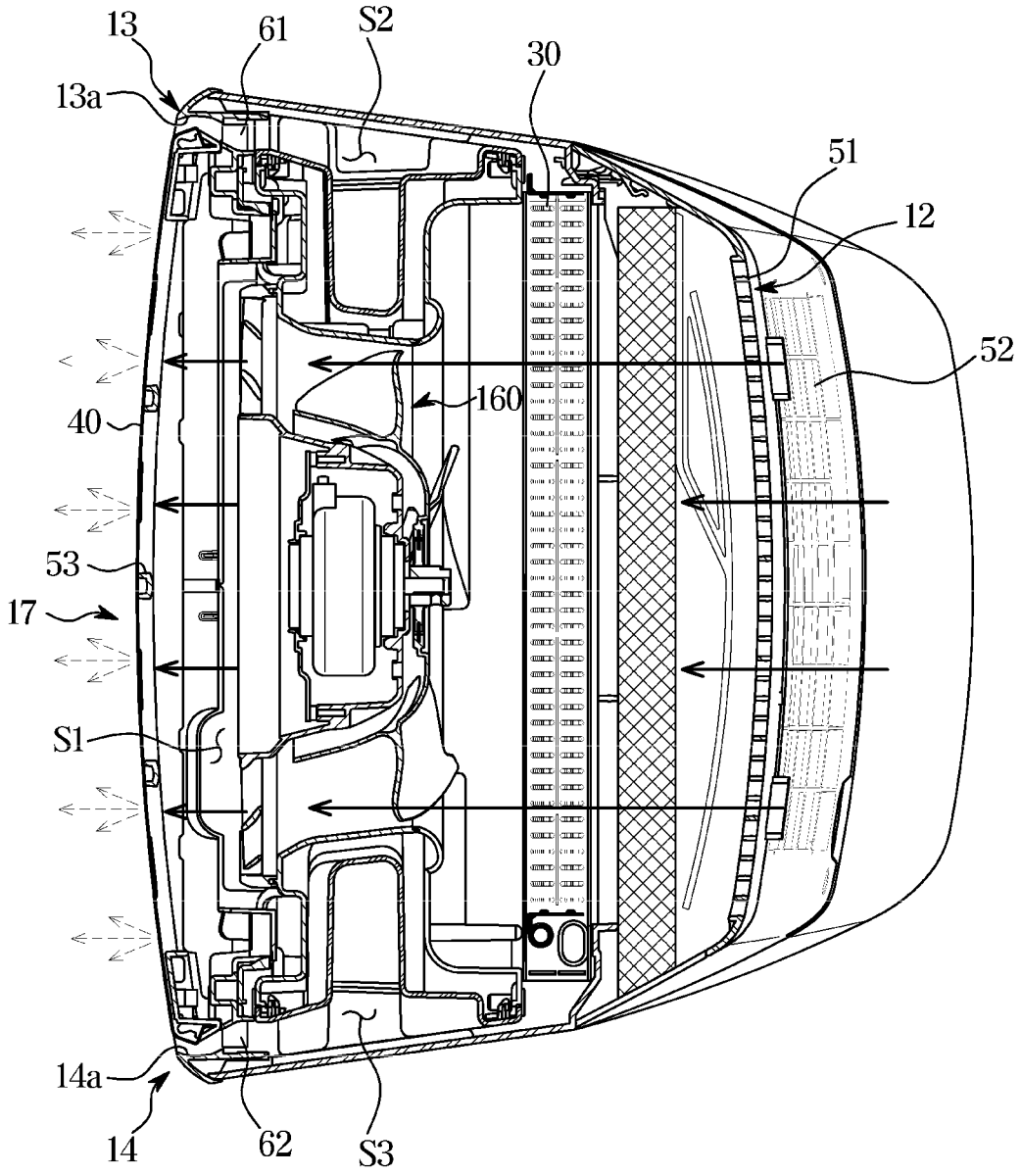
FIG. 4 shows a cross section taken along line A-A' denoted in FIG. 1 in a case in which an air conditioner according to an embodiment blows air to a first flow path.
Figure 5:
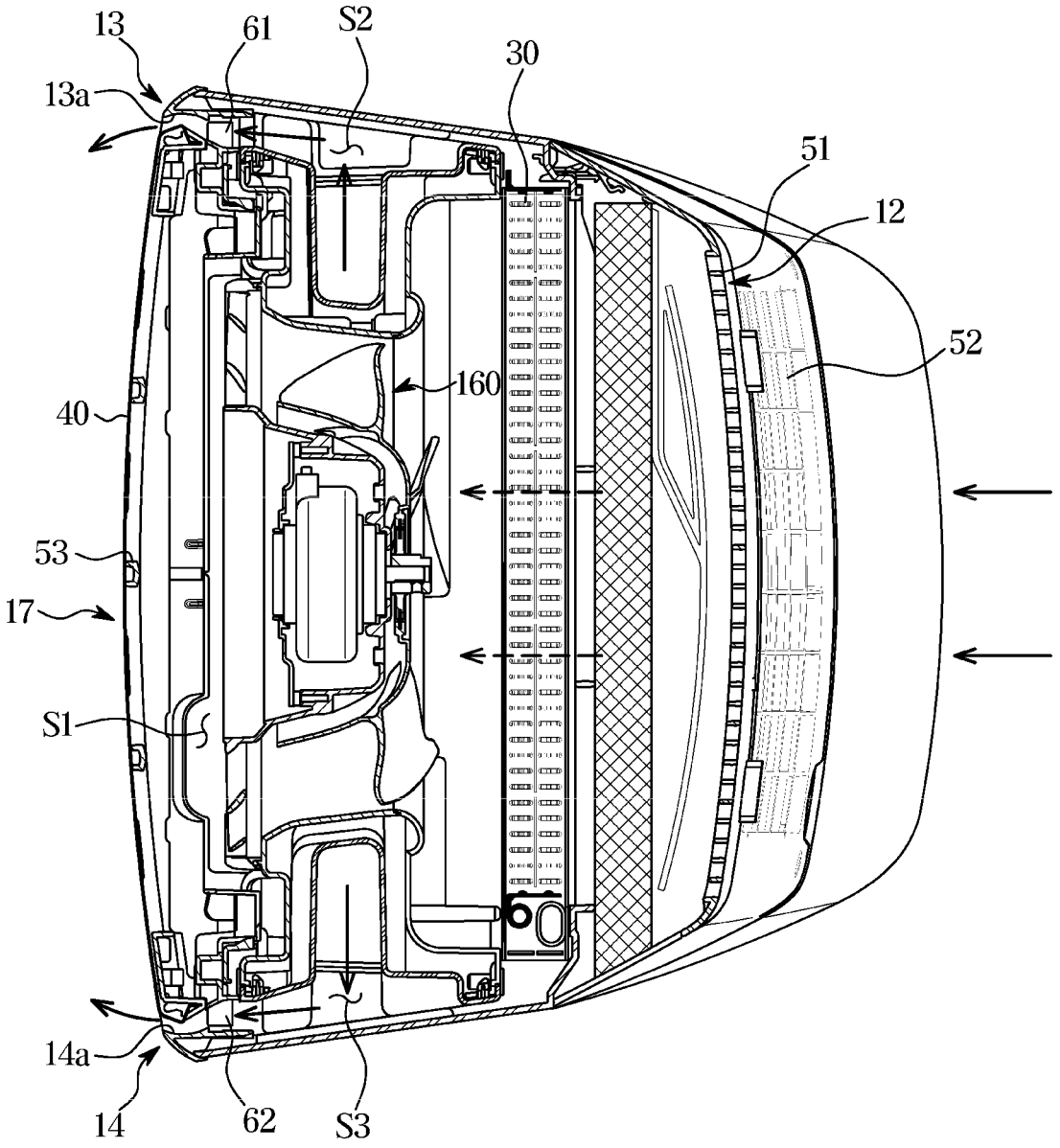
FIG. 5 shows a cross section taken along line A-A' denoted in FIG. 1 in a case in which an air conditioner according to an embodiment blows air to a second flow path and a third flow path.

FIG. 1 shows an outer appearance of an air conditioner according to an embodiment, FIG. 2 shows components related to a flow of a refrigerant in an air conditioner according to an embodiment, FIG. 3 is an exploded view of an air conditioner according to an embodiment, FIG. 4 shows a cross-section taken along line A-A' denoted in FIG. 1 in a case in which an air conditioner according to an embodiment blows air to a first flow path, and FIG. 5 shows a cross-section taken along line A-A' denoted in FIG. 1 in a case in which an air conditioner according to an embodiment blows air to a second flow path and a third flow path.

Referring to FIGS. 1 and 2, an air conditioner 1 may include an outdoor unit 1*a* positioned in an outside space to perform heat exchange between outside air and a refrigerant, and an indoor unit 1*b* positioned in a room space to perform heat exchange between room air and a refrigerant.

That is, the outdoor unit 1*a* may be located outside a space to be air-conditioned, and the indoor unit 1*b* may be located inside the space to be air-conditioned. The space to be air-conditioned may be a space that will be cooled or heated by the air conditioner 1.

The outdoor unit 1*a* may be positioned, for example, outdoor, and the indoor unit 1*b* may be positioned, for example, inside a space separated from outside by walls or partitions, such as a room of a house or a room of an office.

The air conditioner 1 may include a refrigerant flow path for circulating a refrigerant between indoor and outdoor. The refrigerant may circulate between the indoor and the outdoor along the refrigerant flow path, and absorb heat or discharge latent heat during a phase change (for example, a phase change from a gas to a liquid or a phase change from a liquid to a gas).

More specifically, as shown in FIG. 2, the air conditioner 1 may include a liquid pipe P1 being a passage through which a liquid refrigerant flows and a gas pipe P2 being a passage through which a gas refrigerant flows, in addition to the outdoor unit 1*a* and the indoor unit 1*b*, wherein the liquid pipe P1 and the gas pipe P2 connect the outdoor unit 1*a* with the indoor unit 1*b* and extend to inside of the outdoor unit 1*a* and the indoor unit 1*b*.

The outdoor unit 1*a* may include a compressor 170 for compressing a refrigerant, an outdoor heat exchanger 32 for performing heat exchange between outside air and a refrigerant, a 4-way valve 180 for selectively guiding a refrigerant compressed by the compressor 170 to any one of the outdoor heat exchanger 32 and the indoor unit 1*b* according to a cooling process or a heating process, an expansion valve 190 for decompressing a refrigerant, and an accumulator 175 for preventing a liquid refrigerant not yet evaporated from entering the compressor 170.

The compressor 170 may compress a low-pressure gas refrigerant to high-pressure by using a rotation force of a compressor motor (not shown) that rotates by receiving electrical energy from an external power supply.

The 4-way valve 180 may guide a refrigerant compressed by the compressor 170 to the outdoor heat exchanger 32 during a cooling process, and guide a refrigerant compressed by the compressor 170 to the indoor unit 1*b* during a heating process.

The outdoor heat exchanger 32 may condense a refrigerant compressed by the compressor 170 during the cooling process, and evaporate a refrigerant decompressed by the indoor unit 1*b* during the heating process. The outdoor heat exchanger 32 may include an outdoor heat exchanger refrigerant pipe (not shown) through which a refrigerant passes, and an outdoor heat exchanger cooling fin (not shown) for improving heat exchange efficiency between a refrigerant and outside air by widening a surface area which the outside air is in contact with.

Also, the outdoor blower fan 162 may be provided around the outdoor heat exchanger 32 to blow outside air to the outdoor heat exchanger 32, thereby causing the outdoor heat exchanger 32 to perform heat exchange between a refrigerant and the outside air. That is, the outdoor blower fan 162 may blow outside air toward the outdoor heat exchanger 32 to blow the outside air not heat-exchanged to the outdoor heat exchanger 32 while blowing heat-exchanged outside air to outside.

The expansion valve 190 may decompress a refrigerant, while adjusting an amount of a refrigerant that is provided to the outdoor heat exchanger 32 such that sufficient heat exchange occurs in the outdoor heat exchanger 32. More specifically, the expansion valve 190 may decompress a refrigerant by using a throttling effect that a refrigerant passed through a narrow flow path is decompressed without any heat exchange with outside. The expansion valve 190 may adopt an electronic expansion valve (EEV) of which a degree of opening is adjustable to adjust an amount of a refrigerant passing through the expansion valve 190.

The indoor unit 1*b* may include an indoor heat exchanger 30 for performing heat exchange between room air and a refrigerant, and an indoor blower fan 160 for blowing room air to the indoor heat exchanger 30.

The indoor heat exchanger 30 may evaporate a low-pressure liquid refrigerant during a cooling process, and condense a high-pressure gas refrigerant during a heating process. The indoor heat exchanger 30 may include, like the outdoor heat exchanger 32 of the outdoor unit 1*a*, an indoor heat exchanger refrigerant pipe (not shown) through which a refrigerant passes, and an indoor heat exchanger cooling fin (not shown) for improving heat exchange efficiency between a refrigerant and room air.

Also, the indoor blower fan 160 may be positioned around the indoor heat exchanger 30 to blow room air to the indoor heat exchanger 30 to cause the indoor heat exchanger 30 to perform heat exchange between a refrigerant and room air. That is, the indoor blower fan 160 may blow room air toward the indoor heat exchanger 30 to blow the room air not heat-exchanged to the indoor heat exchanger 30 while blowing heat-exchanged room air to an indoor space.

As such, during a cooling process, a refrigerant may discharge heat in the outdoor heat exchanger 32, and absorb heat in the indoor heat exchanger 30. That is, during a cooling process, a refrigerant compressed by the compressor 170 may be first supplied to the outdoor heat exchanger 32 via the 4-way valve 180 and then supplied to the indoor heat exchanger 30. In this case, the outdoor heat exchanger 32 may operate as a condenser that condenses the refrigerant, and the indoor heat exchanger 30 may operate as an evaporator that evaporates the refrigerant.

Also, during a heating process, a refrigerant may discharge heat in the indoor heat exchanger 30 and absorb heat in the outdoor heat exchanger 32. That is, during a heating process, a refrigerant compressed by the compressor 170 may be first supplied to the indoor heat exchanger 30 via the 4-way valve 180 and then supplied to the outdoor heat exchanger 32. In this case, the indoor heat exchanger 30 may operate as a condenser that condenses the refrigerant, and the outdoor heat exchanger 30 may operate as an evaporator that evaporates the refrigerant.

So far, a flow of a refrigerant between the outdoor unit 1*a* and the indoor unit 1*b* of the air conditioner 1 has been described. Hereinafter, a structure of the indoor unit 1*b* will be described in detail. Also, hereinafter, for convenience of description, the indoor heat exchanger 30 will be referred to as a 'heat exchanger', and the indoor blower fan 160 will be referred to as a 'blower fan'.

Referring to FIGS. 1, 3, 4, and 5, the indoor unit 1*b* may include a housing 10 forming an outer appearance, the blower fan 160 for circulating air to inside or outside of the housing 10, and the heat exchanger 30 for performing heat exchange with air entered the inside of the housing 10.

The housing 30 may include a body case 11 in which the blower fan 160 and the heat exchanger 30 are installed, and a front panel 16 covering a front surface of the body case 11. The housing 10 may include a first inlet 12, a second inlet 15, a main outlet 17, and guide outlets 13 and 14.

The body case 11 may form a rear surface, both side surfaces, a top, and a bottom of the indoor unit 1*b*. The body case 11 may open at a front side, and the open front side may form a body case opening 11*a*. The body case opening 11*a* may be covered by a front panel 16 and an outlet panel 40.

The front panel 16 may be coupled with the body case opening 11*a*. In FIG. 3, the front panel 16 is shown to be separable from the body case 11. However, the front panel 16 and the body case 11 may be integrated into one body.

In the front panel 16, the main outlet 17 may be formed. The main outlet 17 may be positioned in a front portion of the housing 10. The main outlet 17 may penetrate the front panel 16. The main outlet 17 may be formed in an upper portion of the front panel 16. The main outlet 17 may substantially face the first inlet 12. Air heat-exchanged inside the housing 10 may be discharged to the outside of the housing 10 through the main outlet 17. The main outlet 17 may discharge air entered through the first inlet 12.

On the portion of the front panel 16 in which the main outlet 17 is formed, a panel support member 17*a* supporting the outlet panel 40 may be formed. The panel support member 17*a* may extend along a circumference of the main outlet 17. The panel support member 17*a* may support a rear surface of the outlet panel 40.

In the body case 11, the first inlet 12 may be formed. The first inlet 12 may penetrate a rear plate of the body case 11. The first inlet 12 may be formed in an upper portion of the rear plate of the body case 11. Outside air may enter the inside of the housing 10 through the first inlet 12.

In FIG. 3, two first inlets 12 are shown. However, the number of the first inlets 12 is not limited to this, and various numbers of first inlets 12 may be provided as necessary. In FIG. 3, the first inlet 12 is shown to be in a shape of a quadrangle. However, the shape of the first inlet 12 is not limited to this, and various shapes of the first inlet 12 may be formed as necessary.

In the body case 11, a second inlet 15 may be formed. The second inlet 15 may penetrate the rear plate of the body case 11. The second inlet 15 may be formed in a lower portion of the rear plate of the body case 11. The second inlet 15 may be formed below the first inlet 12. Outside air may enter the inside of the housing 10 through the second inlet 15.

Like the first inlet 12, the second inlet 15 may also change in number and/or shape as necessary.

The front panel 16 may form the guide outlets 13 and 14 together with the outlet panel 40. The guide outlets 13 and 14 may be formed on the same plane as the main outlet 17. The guide outlets 13 and 14 may be formed to a left and/or right side of the main outlet 17. The guide outlets 13 and 14 may be positioned adjacent to the main outlet 17. The guide outlets 13 and 14 may be spaced a preset distance from the main outlet 17. The guide outlets 13 and 14 may include a first guide outlet 13 positioned to the left side of the main outlet 17, and a second guide outlet 14 positioned to the right side of the main outlet 17.

The guide outlets 13 and 14 may extend in an up-down direction of the body case 11. The guide outlets 13 and 14 may have the substantially same length as the main outlet 17. Air not heat-exchanged inside the housing 10 may be discharged to the outside of the housing 10 through the guide outlets 13 and 14. The guide outlets 13 and 14 may discharge air entered through the second inlet 15.

The guide outlets 13 and 14 may mix air to be discharged from the guide outlets 13 and 14 with air discharged from the main outlet 17. More specifically, a portion of the front panel 16, forming the guide outlets 13 and 14, may include guide curved portions 13*a* and 14*a* (see FIGS. 4 and 5) for guiding air to be discharged from the guide outlets 13 and 14 to mix the air with air discharged from the main outlet 17.

Air that is discharged through the guide outlets 13 and 14 may be discharged in a direction in which the air may mix with air discharged from the main outlet 17 along the guide curved portions 13*a* and 14*a*. The guide curved portions 13*a* and 14*a* may guide air to be discharged through the guide outlets 13 and 14 to be discharged in the substantially same direction as air discharged through the main outlet 17. The guide curved portions 13*a* and 14*a* may guide air to be discharged through the guide outlets 13 and 14 forward.

On the guide outlets 13 and 14, blades 61 and 62 (see FIGS. 4 and 5) for guiding air to be discharged through the guide outlets 13 and 14 may be provided. The blades 61 and 62 may be arranged continuously along a longitudinal direction of the guide outlets 13 and 14. A first blade 61 may be positioned on the first guide outlet 13, and a second blade 62 may be positioned on the second guide outlet 14.

A flow path through which air flows and which connects the first inlet 12 with the main outlet 17 is referred to as a first flow path S1, a flow path through which air flows and which connects the second inlet 15 with the first guide outlet 13 is referred to as a second flow path S2, and a flow path through which air flows and which connects the second inlet 15 with the second guide outlet 14 is referred to as a third flow path S3. The first flow path S1 may be partitioned from the second flow path S2 and the third flow path S3. Accordingly, air flowing through the first flow path S1 may not mix with air flowing through the second flow path S2 and the third flow path S3. The second flow path S2 may overlap with the third flow path S3 at a certain area. More specifically, the second flow path S2 may overlap with the third flow path S3 at an area ranging from the second inlet 15 to a guide blower fan 165.

Inside the housing 10, a first duct 18 for partitioning the first flow path S1 from the second flow path S2 may be positioned. The first duct 18 may be positioned to a left side of the blower fan 160. The first duct 18 may extend along the up-down direction. The first duct 18 may communicate with the guide blower fan 165. The first duct 18 may communicate with a fan outlet 165*a* of the guide blower fan 165. The first duct 18 may guide a part of air blown by the guide blower fan 165 to the first guide outlet 13. In the first duct 18, a first duct filter (not shown) for filtering foreign materials of air transferred from the guide blower fan 165 may be provided.

Inside the housing 10, a second duct 19 for partitioning the first flow path S1 from the third flow path S3 may be positioned. The second duct 19 may be positioned to a right side of the blower fan 160. The second duct 19 may extend along the up-down direction. The second duct 19 may communicate with the guide blower fan 165. The second duct 19 may communicate with the fan outlet 165*a* of the guide blower fan 165. The second duct 19 may guide a part of air blown by the guide blower fan 165 to the second guide outlet 14. In the second duct 19, a second duct filter 19*a* for filtering foreign materials of air transferred from the guide blower fan 165 may be provided.

The indoor unit 1*b* may discharge air heat-exchanged by the heat exchanger 30 through the main outlet 17 and discharge air not passed through the heat exchanger 30 through the guide outlets 13 and 14. That is, the guide outlets 13 and 14 may discharge air not heat-exchanged. Because the heat exchanger 30 is positioned on the first flow path S1, air discharged through the main outlet 17 may be heat-exchanged air. Because no heat exchanger is positioned on the second flow path S2 and the third flow path S3, air discharged through the guide outlets 13 and 14 may be air not heat-exchanged.

Meanwhile, according to another embodiment, heat-exchanged air may be discharged through the guide outlets 13 and 14. That is, heat exchangers may also be positioned on the second flow path S2 and the third flow path S3. More specifically, a heat exchanger for heat-exchanging air to be discharged through the guide outlets 13 and 14 may be positioned in an accommodating space 11*b* of the body case 11. According to the configuration, the air conditioner 1 may provide heat-exchanged air through all of the main outlet 17 and the guide outlets 13 and 14.

The accommodating space 11*b* in which electronic parts (not shown) are positioned may be formed inside the body case 11. Electronic parts required for driving the air conditioner 1 may be positioned in the accommodating space 11*b*. The guide blower fan 165 may be positioned in the accommodating space 11*b*.

The guide blower fan 165 may be driven independently from the blower fan 160. Revolutions per minute (RPM) of the guide blower fan 165 may be different from RPM of the blower fan 160.

The blower fan 160 may be positioned on the first flow path S1 formed between the first inlet 12 and the main outlet 17. Air may enter the inside of the housing 10 through the first inlet 12 by the blower fan 160. The air entered through the first inlet 12 may move along the first flow path S1 and be discharged to the outside of the housing 10 through the main outlet 17.

The blower fan 160 may be an axial flow fan or a mixed flow fan. However, a kind of the blower fan 160 is not limited to these, and the blower fan 160 may have any configuration capable of moving air entered from the outside of the housing 10 to discharge the air to the outside of the housing 10. For example, the blower fan 160 may be a cross fan, a turbo fan, or a sirocco fan.

In FIG. 3, three blower fans 160 are shown. However, the number of the blower fans 160 is not limited to three. That is, an arbitrary number of the blower fans 160 may be provided as necessary.

The guide blower fan 165 may be positioned on the second flow path S2 and the third flow path S3 formed between the second inlet 15 and the guide outlets 13 and 14. Air may enter the inside of the housing 10 through the second inlet 15 by the guide blower fan 165. A part of air entered through the second inlet 15 may move along the second flow path S2 and be discharged to the outside of the housing 10 through the first guide outlet 13, or the part of the air may move along the third flow path S3 and be discharged to the outside of the housing 10 through the second guide outlet 14. The guide blower fan 165 may be implemented as a circulator according to an embodiment.

The heat exchanger 30 may be positioned between the blower fan 160 and the first inlet 12. The heat exchanger 30 may be positioned on the first flow path S1. The heat exchanger 30 may absorb heat from air entered through the first inlet 12, or transfer heat to air entered through the first inlet 12. The heat exchanger 30 may include a tube, and a header coupled with the tube. However, a kind of the heat exchanger 30 is not limited to this.

The indoor unit 1*b* may include the outlet panel 40 positioned on the portion of the front panel 16 in which the main outlet 17 is formed. That is, the outlet panel 40 may be coupled with the housing 10 through the front panel 16. The outlet panel 40 may include a plurality of holes to cause air discharged from the main outlet 17 to be discharged more slowly than air discharged from the guide outlets 13 and 14. The plurality of holes may penetrate inner and outer surfaces of the outlet panel 40. The plurality of holes may be formed in a fine size. The plurality of holes may be uniformly distributed throughout an entire area of the outlet panel 40. Heat-exchanged air discharged through the main outlet 17 may be discharged uniformly at low speed by the plurality of holes. In a lower end portion of the outlet panel 40, a blocking portion 40*a* in which none of the plurality of holes is formed may be provided.

Meanwhile, according to another embodiment, the indoor unit 1*b* may not include the outlet panel 40, and heat-exchanged air may be discharged to a space to be air-conditioned through the main outlet 17. In this case, the main outlet 17 may be configured to discharge heat-exchanged air directly to the outside (space to be air-conditioned). That is, the main outlet 17 may be exposed to the outside of the housing 10. In this case, air entered the first inlet 12 may be heat-exchanged in the heat exchanger 30 and then discharged to an indoor space (a space to be air-conditioned) through the main outlet 17. In other words, in a case in which the indoor unit 1*b* does not include the outlet panel 40, air may be discharged to the outside through the main outlet 17 without being reduced in speed by the outlet panel 40. In this case, the indoor unit 1*b* may include or not include components constituting the guide flow paths S2 and S3, such as the second inlet 15, the guide blower fan 165, a distributor 55, the first duct 18, the second duct 19, and the guide outlets 13 and 14, according to embodiments.

The indoor unit 1*b* may include a first inlet grill 51 coupled with the portion of the body case 11 in which the first inlet 12 is formed. The first inlet grill 51 may prevent foreign materials from entering through the first inlet 12. For this, the first inlet grill 51 may include a plurality of slits or holes. The first inlet grill 51 may cover the first inlet 12.

The indoor unit 1*b* may include a second inlet grill 52 coupled with the portion of the body case 11 in which the second inlet 15 is formed. The second inlet grill 52 may prevent foreign materials from entering through the second inlet 15. For this, the second inlet grill 52 may include a plurality of slits or holes. The second inlet grill 51 may cover the second inlet 15.

The indoor unit 1*b* may include an outlet grill 53 coupled with the portion of the front panel 16 in which the main outlet 17 is formed. The outlet grill 53 may be installed on the panel support member 17*a*. The outlet grill 53 may prevent foreign materials from being discharged through the main outlet 17. For this, the outlet grill 53 may include a plurality of slits or holes. The outlet grill 53 may cover the main outlet 17.

The indoor unit 1*b* may include the distributor 55. The distributor 55 may be positioned inside the housing 10. The distributor 55 may be positioned in the accommodating space 11*b* of the body case 11. The distributor 55 may be positioned adjacent to the fan outlet 165*a* of the guide blower fan 165. The distributor 55 may be positioned at a location at which air entered through the second inlet 15 diverges toward the first guide outlet 13 and the second guide outlet 14. The distributor 55 may be positioned between the first inlet 12 and the second inlet 15. The distributor 55 may distribute air blown by the guide blower fan 165 to the first duct 18 and the second duct 19. The distributor 55 may adjust a flow rate of air that is discharged through the first guide outlet 13 and the second guide outlet 14.

Meanwhile, according to another embodiment, the indoor unit 1*b* may further include at least one outlet (not shown) positioned in the portion of the front panel 16 in which the main outlet 17 is formed, and a door (not shown) for opening or closing the outlet. The outlet may discharge heat-exchanged air directly to the outside. That is, the outlet may be exposed to the outside of the housing 10. The door may open or close the outlet, and heat-exchanged air may be discharged to the outside of the housing 10 selectively through the outlet. That is, the door may move between an open position of opening the outlet and a close position of closing the outlet. The door may move in a front-rear direction between the open position and the close position. In this case, the outlet panel 40 may be formed only at an area at which the outlet is not formed.

In this case, air entered the first inlet 12 may be heat-exchanged in the heat exchanger 30 and then discharged to the indoor space through the outlet, or the air may be heat-exchanged in the heat exchanger 30 and then discharged to the indoor space through the plurality of holes of the outlet panel 40. That is, upon opening of the outlet by the door, heat-exchanged air may be discharged to the indoor space through the outlet and the plurality of holes of the outlet panel 40, and upon closing of the outlet by the door, the heat-exchanged air may be discharged to the indoor space through the plurality of holes of the outlet panel 40. In other words, air in the first flow path S1 configured with the first inlet 12 and the heat exchanger 30 may be blown to both the outlet and the outlet panel 40. In this case, the indoor unit 1*b* may include none of components constituting the guide flow paths S2 and S3, such as the second inlet 15, the guide blower fan 165, the distributor 55, the first duct 18, the second duct 19, and the guide outlets 13 and 14.

That is, the indoor unit 1*b* may control a door actuator (not shown) to open the outlet, and air entered the first inlet 12 may pass through the heat exchanger 30 and be discharged to the outside of the indoor unit 1*b* through the outlet. At this time, a part of the air passed through the heat exchanger 30 may be discharged through the plurality of holes.

Also, the indoor unit 1*b* may control the door actuator to close the outlet, and air entered the first inlet 12 may pass through the heat exchanger 30 and be discharged to the outside of the indoor unit 1*b* through the plurality of holes provided in the outlet panel 40. The discharged air may be reduced in speed by passing through the plurality of holes, and accordingly, wind speed may be slower than in a case in which air is charged through the outlet.

As such, the indoor unit 1*b* may change a flow path of air entered the first inlet 12 by controlling opening and closing of the outlet exposed to the outside of the housing 10, thereby adjusting wind speed of air that is discharged to the outside of the indoor unit 1*b*.

So far, a structure of the indoor unit 1*b* has been described in detail. Hereinafter, driving of the air conditioner 1 will be described in detail with reference to FIGS. 4 and 5.

Referring first to FIG. 4, the air conditioner 1 may be driven in a first mode of discharging heat-exchanged air only through the main outlet 17. Because the outlet panel 40 is positioned on the main outlet 17, the whole indoor space may be slowly air-conditioned. That is, in a case in which air is discharged to the outside of the housing 10 through the main outlet 17, the air may be reduced in wind speed by passing through the plurality of holes of the outlet panel 40 and discharged at low speed. According to the configuration, a user may cool or heat the indoor space at wind speed at which he/she feels pleasant.

More specifically, according to driving of the blower fan 160, outside air of the housing 10 may enter the inside of the housing 10 through the first inlet 12. The air entered the inside of the housing 10 may pass through the heat exchanger 30 to thereby be heat-exchanged. The heat-exchanged air passed through the heat exchanger 30 may pass through the outlet panel 40 via the blower fan 160 to thus be reduced in speed, and then be discharged to the outside of the housing 10 through the main outlet 17. That is, the heat-exchanged air passed through the first flow path S1 may be discharged at wind speed at which a user feels pleasant.

In the first mode, because the guide blower fan 165 is not driven, no air may be discharged through the guide outlets 13 and 14.

Referring to FIG. 5, the air conditioner 1 may be driven in a second mode of discharging air not heat-exchanged only through the guide outlets 13 and 14. Because no heat exchanger is positioned on the second flow path S2 and the third flow path S3, the indoor unit 1*b* may circulate room air.

Because the guide curved portions 13*a* and 14*a* are provided in the guide outlets 13 and 14, air discharged through the guide outlets 13 and 14 may be discharged in the front direction from the indoor unit 1*b*. Because the blades 61 and 62 are provided on the guide outlets 13 and 14, the air may be blown farther in the front direction.

More specifically, as the guide blower fan 165 is driven, outside air of the housing 10 may enter the inside of the housing 10 through the second inlet 15. The air entered the inside of the housing 10 may pass through the guide blower fan 165, and then move to the second flow path S2 and the third flow path S3 respectively formed at both sides of the first flow path S1. The air may move upward on the second flow path S2 and the third flow path S3, and then be discharged to the outside of the housing 10 through the guide outlets 13 and 14. At this time, the air may be guided toward the front direction from the air conditioner 1 along the guide curved portions 13*a* and 14*a*.

In the second mode, because the blower fan 160 is not driven, no air may be discharged through the main outlet 17. That is, in the second mode, the air conditioner 1 may blow air not heat-exchanged, and accordingly, the air conditioner 1 may perform a function of simply circulating room air or provide strong wind to a user.

Also, the air conditioner 1 may be driven in a third mode of discharging heat-exchanged air through the main outlet 17 and the guide outlets 13 and 14. The air conditioner 1 may discharge cool air farther in the third mode than in the first mode.

More specifically, in a case in which the air conditioner 1 is driven in the third mode, cool air or hot air discharged through the main outlet 17 may mix with air discharged through the guide outlets 13 and 14. Furthermore, because air discharged through the guide outlets 13 and 14 moves at higher speed than air discharged through the main outlet 17, the air discharged through the guide outlets 13 and 14 may move heat-exchanged air discharged through the main outlet 17 farther.

According to the configuration, the air conditioner 1 may provide a user with pleasant cool air or hot air resulting from mixing heat-exchanged air with room air.

The air conditioner 1 according to an embodiment may be driven in any one of the first mode, the second mode, or the third mode in a case in which the heat exchanger 30 performs a cooling process of evaporating a refrigerant. That is, during the cooling process, the air conditioner 1 may be driven in any one of the first mode of discharging heat-exchanged air only through the first flow path S1, the second mode of discharging air only through the guide flow paths S2 and S3, or the third mode of discharging air through all of the first flow path S1 and the guide flow paths S2 and S3.

During the cooling process, the heat exchanger 30 may be cooled by a refrigerant, and as a result of contacting of air sucked through the first inlet 12 with the cooled heat exchanger 30, water may be condensed on a surface of the heat exchanger 30. Because the blower fan 160 blows air during the cooling process, the water condensed on the surface of the heat exchanger 30 may be collected in a drain container provided below the heat exchanger 30 by the blown air.

In a case in which the blower fan 160 stops after the cooling process terminates, the water condensed on the heat exchanger 30 may be no longer removed. Water condensed on the first inlet 12, the main outlet 17, and the outlet panel 40, as well as the heat exchanger 30, may also be no longer removed. Due to the water, microbes may propagate on the heat exchanger 30, the first inlet 12, the main outlet 17, and the outlet panel 40, and accordingly, stain may be generated and an odor may be created.

To prevent these, the air conditioner 1 may perform a drying process for drying condensed water on the surface of the heat exchanger 30 after the cooling process terminates.

The drying process may include a blowing process of operating the blower fan 160 in a state of stopping the compressor 170, and a heating process of changing a circulating direction of a refrigerant with the 4-way valve 180 while operating both the compressor 170 and the blower fan 160. As such, the air conditioner 1 according to an embodiment may include a heating process of condensing a refrigerant in the heat exchanger 30 as a stage of the drying process to thereby completely dry condensed water by emitting heat from the surface of the heat exchanger 30.

Also, the air conditioner 1 according to an embodiment may be driven in the first mode during the drying process for drying condensed water on the surface of the heat exchanger 30. That is, during the drying process, the guide blower fan 165 may stop, and blowing of air through the guide flow paths S2 and S3 may be limited. Thereby, air heat-exchanged by the heating process may be discharged to the indoor space only through the plurality of holes of the outlet panel 40. Accordingly, a less amount of heat may diffuse to the indoor space than in a case in which air is discharged through the guide outlets 13 and 14, and the drying process may be performed with low noise.

Meanwhile, according to another embodiment, in a case in which the indoor unit 1*b* further includes at least one outlet positioned in the portion of the front panel 16 in which the main outlet 17 is formed, and a door for opening or closing the outlet, the air conditioner 1 according to an embodiment may control, during a drying process for drying condensed water on the surface of the heat exchanger 30, the door to close the outlet to be driven in the first mode. Thereby, air heat-exchanged by the heating process may be discharged to the indoor space only through the plurality of holes of the outlet panel 40. Accordingly, a less amount of heat may diffuse to the indoor space than in the case in which air is discharged through the outlet, and the drying process may be performed with low noise. That is, the indoor unit 1*b* may close the outlet exposed to the outside of the housing 10 to change a flow path of air entered the first inlet 12 and cause the air to be reduced in speed and discharged through the plurality of holes of the outlet panel 40. However, according to an embodiment, the indoor unit 1*b* may perform the drying process in a state of opening the outlet. This will be described in detail, below.

Meanwhile, according to another embodiment, in a case in which the indoor unit 1*b* does not include the outlet panel 40 and the main outlet 17 is exposed to the outside of the housing 10, the air conditioner 1 may perform a drying process by moving air through the main outlet 17. That is, the air conditioner 1 may perform a drying process by controlling the blower fan 160 and the compressor 170, and cause air entered the first inlet 12 to pass through the heat exchanger 30 and be discharged to the indoor space through the main outlet 17. Thereby, the air conditioner 1 may dry condensed water of the heat exchanger 30.

So far, the driving and the drying process of the indoor unit 1*b* have been described. Hereinafter, an operation of performing the drying process in the air conditioner 1 by controlling the individual components will be described in more detail.

Figure 6:
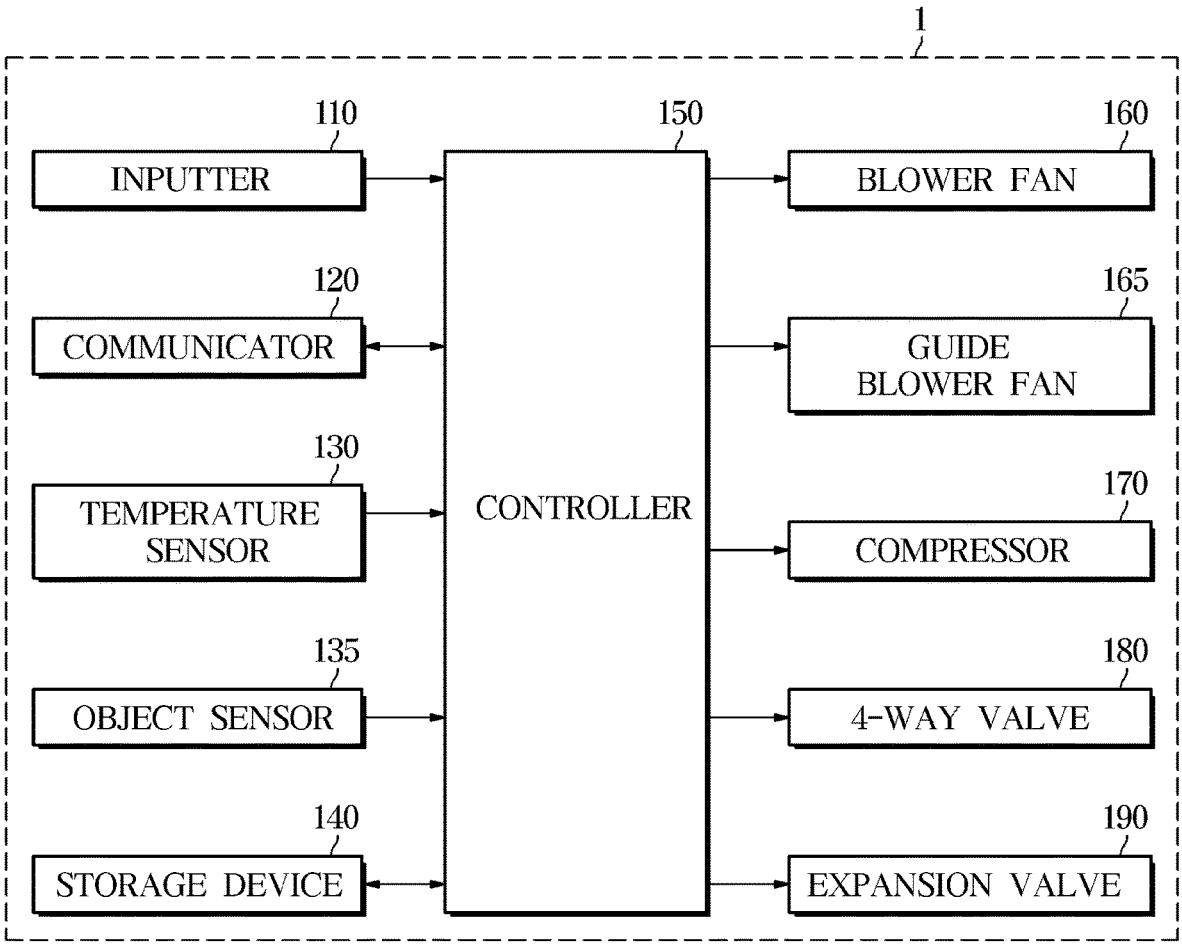
FIG. 6 is a control block diagram of an air conditioner according to an embodiment.

FIG. 6 is a control block diagram of the air conditioner 1 according to an embodiment.

Referring to FIG. 6, the air conditioner 1 may include an inputter 110, a communicator 120, a temperature sensor 130, an object sensor 135, a storage device 140, a controller 150, the blower fan 160, the guide blower fan 165, the compressor 170, the 4-way valve 180, and the expansion valve 190.

At least one component may be added or deleted in correspondence to the performances of the components of the air conditioner 1 shown in FIG. 6. Also, it will be easily understood to one of ordinary skill in the art that the relative positions of the components may change in correspondence to the performance or structure of the system.

The inputter 110 according to an embodiment may receive a user input related to an operation of the air conditioner 1 from a user, and output an electrical signal (a voltage or current) corresponding to the received user input to the controller 150.

The inputter 110 may include a plurality of buttons provided on the housing 10. For example, the inputter 110 may include a button for setting target temperature of an indoor space (a space to be air-conditioned), a button for selecting any one of the first mode, the second mode, or the third mode, a button for setting strength (rpm of the fan) of wind, a button for inputting a command for a drying process, etc.

The plurality of buttons may include a push switch and a membrane switch that operate by a user's pressing operation, a touch switch that operates by a contact with a user's body part, etc.

The inputter 110 may include a remote controller provided separately from the air conditioner 1, and a receiver for receiving a wireless signal from the remote controller. The remote controller may include a plurality of buttons, like the housing 10.

The communicator 120 according to an embodiment may communicate with an access point (AP) (not shown) provided in a space to be air-conditioned, and connect to a network through the access point to communicate with a terminal.

The communicator 120 may receive information about a terminal connected to the access point from the access point, and transfer the received information to the controller 150.

Also, the communicator 120 may receive position information (for example, a global positioning system (GPS) signal) of the terminal from the terminal, and transfer the received information to the controller 150.

For this, the communicator 120 may be configured with a known type of wired communication module or a known type of wireless communication module.

The temperature sensor 130 according to an embodiment may be provided to one side of the heat exchanger 30 to detect temperature of a refrigerant.

More specifically, the temperature sensor 130 may detect, in a case in which a refrigerant is condensed in the heat exchanger 30 during a heating process, condensation temperature of the refrigerant, and transfer an electrical signal (a voltage or current) representing the detected temperature to the controller 150.

For example, the temperature sensor 130 may include a thermistor of which an electrical resistance value changes according to temperature.

The object sensor 135 according to an embodiment may detect an object existing in the space to be air-conditioned. More specifically, the object sensor 135 may detect an occupant existing in the space to be air-conditioned.

For this, the object sensor 135 may be provided in the housing 10, and may be an infrared sensor, a radar sensor, etc. However, a kind of the object sensor 135 is not limited as long as the object sensor 135 can detect a moving occupant in a space to be air-conditioned.

The storage device 140 according to an embodiment may store various information required for control. For example, the storage device 140 may store information about control content for individual components in each stage of a drying process, information about a terminal connected to the access point, position information of the terminal, information about a time at which a command for a drying process is received, information about a time for which no occupant exists, etc. Also, according to an embodiment, the storage device 140 may store a neural network for training a time for which no occupant exists.

The storage device 140 may be provided as a known type of storage medium to store various information.

The controller 150 according to an embodiment may perform a drying process after a cooling process terminates. More specifically, the controller 150 may perform a blowing process and a heating process sequentially by controlling the blower fan 160 and the compressor 170.

That is, the controller 150 may dry condensed water on the surface of the heat exchanger 30 by operating only the blower fan 160 in a state of stopping the compressor 170 to blow air to the heat exchanger 30 for a preset blowing process time.

Also, the controller 150 may completely dry the condensed water on the surface of the heat exchanger 30 by controlling the 4-way valve 180 to change a circulating direction of a refrigerant and then operating the blower fan 160 and the compressor 170 for a preset heating process time to condense the refrigerant in the heat exchanger 30 and transfer heat to the condensed water on the surface of the heat exchanger 30.

According to an embodiment, the controller 150 may terminate the heating process in a case in which the preset heating process time elapses after the heating process starts or in a case in which condensation temperature of the heat exchanger 30 is higher than or equal to target condensation temperature.

According to an embodiment, after the heating process terminates, the controller 150 may operate the compressor 170 for a preset operation time such that the refrigerant is evaporated in the heat exchanger 30.

That is, according to an elapse of a preset switching time after the heating process terminates, the controller 150 may control the 4-way valve 180 to change the circulating direction of the refrigerant to a circulating direction for a cooling process, and operate the compressor 170 for the preset operation time after controlling the 4-way valve 180 to cool the heat exchanger 30, thereby removing remaining heat.

Performing the drying process after the cooling process terminates will be described in detail, below.

Upon reception of a command for a drying process from a user through the inputter 110, the controller 150 according to an embodiment may perform a dehumidifying process and a freezing process sequentially by controlling the blower fan 160 and the compressor 170, and after the freezing process terminates, the controller 150 may perform a blowing process and a heating process sequentially by controlling the blower fan 160 and the compressor 170.

That is, in a case of performing a drying process by receiving a command for a drying process through the inputter 110, compared to a case of performing a drying process after a cooling process terminates, the controller 150 may preferentially perform a dehumidifying process and a freezing process before a blowing process and a heating process. As such, the controller 150 may forcedly generate condensed water on the surface of the heat exchanger 30 by preferentially performing the dehumidifying process and the freezing process, and then perform the blowing process and the heating process sequentially.

More specifically, the controller 150 may operate the blower fan 160 and the compressor 170 for a preset dehumidifying process time such that the heat exchanger 30 operates as an evaporator. At this time, as the heat exchanger 30 is cooled, condensed water may be generated on the surface of the heat exchanger 30.

Thereafter, the controller 150 may operate the blower fan 160 and the compressor 170 for a preset freezing process time to freeze the heat exchanger 30.

More specifically, the controller 150 may adjust target evaporation temperature of a refrigerant in the heat exchanger 30 to lower temperature to lower temperature of the surface of the heat exchanger 30 to a freezing point such that condensed water on the surface of the heat exchanger 30 is frozen as ice capsules.

Also, the controller 150 may adjust at least one of rpm of the blower fan 160, an operating frequency of the compressor 170, or a degree of opening of the expansion valve 190 such that the refrigerant is evaporated at the target evaporation temperature.

That is, the controller 150 may control the blower fan 160 such that rpm of the blower fan 160 during the freezing process is lower than rpm during the dehumidifying process (cooling process). Thereby, heat-exchange capability of the heat exchanger 30 may be improved, and a flow velocity of air on the surface of the heat exchanger 30 may be lowered to accumulate energy. Accordingly, evaporation temperature of the heat exchanger 30 may be lowered, and the condensed water on the surface of the heat exchanger 30 may be frozen.

Also, the controller 150 may control the compressor 170 such that an operating frequency of the compressor 170 during the freezing process is higher than an operating frequency during the dehumidifying process (cooling process). Thereby, heat-exchange capability of the heat exchanger 30 may be improved, evaporation temperature of the heat exchanger 30 may be lowered, and the condensed water on the surface of the heat exchanger 30 may be frozen.

Also, the controller 150 may narrow a degree of opening of the expansion valve 190 such that a flow rate of a refrigerant during the freezing process is lower than a flow rate of a refrigerant during the dehumidifying process (cooling process). Thereby, evaporation pressure may be lowered to boil the refrigerant and absorb heat, and as surface temperature of the heat exchanger 30 is lowered, evaporation temperature of the heat exchanger 30 may be lowered.

As such, while the air conditioner 1 performs the freezing process, the condensed water on the surface of the heat exchanger 30 may be frozen, and contaminants, such as dust, foreign materials, etc., existing on the surface of the heat exchanger 30 may be detached from the surface of the heat exchanger 30 by the frozen, condensed water.

After the freezing process terminates, the controller 150 may perform a blowing process of blowing air to the heat exchanger 30 by operating the blower fan 160 in a state of stopping the compressor 170. Through the blowing process, the frozen, condensed water may melt, and the contaminants may be naturally discharged from the heat exchanger 30 together with the melt, condensed water.

After the blowing process terminates, the controller 150 may perform a heating process by controlling the blower fan 160 and the compressor 170. At this time, according to an embodiment, the controller 150 may adjust target condensation temperature to higher temperature to supply higher heat to the heat exchanger 30 than in a drying process that is performed according to termination of a cooling process.

As such, the air conditioner 1 may perform the blowing process and the heating process sequentially after the freezing process to dry condensed water while removing contaminants from the heat exchanger 30.

However, according to an embodiment, upon reception of a command for a drying process from a user through the inputter 110, the air conditioner 1 may perform a dehumidifying process, a blowing process, and a heating process sequentially without performing a freezing process. That is, after a dehumidifying process terminates, the controller 150 may perform a blowing process and a heating process sequentially without performing a freezing process.

In other words, upon reception of a command for a drying process from a user through the inputter 110, the drying process may include a dehumidifying process, a freezing process, a blowing process, and a heating process, or the drying process may include a dehumidifying process, a blowing process, and a heating process, according to embodiments.

In this case, the controller 150 may operate only the blower fan 160 and stop the guide blower fan 165 to discharge air only through the plurality of holes during the drying process. That is, the controller 150 may perform, during the drying process, a control operation of supplying power only to a fan motor corresponding to the blower fan 160 while blocking power to be supplied to a fan motor corresponding to the guide blower fan 165.

Meanwhile, according to another embodiment, in a case in which the indoor unit 1*b* further includes at least one outlet positioned in the portion of the front panel 16 in which the main outlet 17 is formed, and a door for opening or closing the outlet, the controller 150 may operate the blower fan 160 while controlling the door to close the outlet, to discharge air only through the plurality of holes during the drying process. That is, the indoor unit 1*b* may change a flow path of air entered the first inlet 12 by closing the outlet exposed to the outside of the housing 10 such that the air is reduced in speed and discharged through the plurality of holes of the outlet panel 40.

However, according to an embodiment, the indoor unit 1*b* may perform the drying process in a state of opening the outlet. More specifically, according to an embodiment, upon reception of a command for a drying process from a user through the inputter 110, the controller 150 may perform the drying process in a state of controlling the door actuator to open the outlet.

Meanwhile, according to another embodiment, in a case in which the indoor unit 1*b* does not include the outlet panel 40 and the main outlet 17 is exposed to the outside of the housing 10, the air conditioner 1 may perform a drying process by moving air through the main outlet 17. That is, the air conditioner 1 may perform a drying process by controlling the blower fan 160 and the compressor 170 such that air entered the first inlet 12 passes through the heat exchanger 30 and then is discharged to an indoor space through the main outlet 17. Thereby, the air conditioner 1 may dry condensed water of the heat exchanger 30.

Performing a drying process based on a command for a drying process, received from a user, will be described in detail, below.

The controller 150 according to an embodiment may identify whether to perform a drying process based on whether an occupant exists in a space to be air-conditioned.

According to an embodiment, the controller 150 may perform a drying process by controlling the blower fan 160 and the compressor 170 according to an identification that no occupant exists in a space to be air-conditioned based on an output from the object sensor 135.

For example, according to an identification that no occupant exists in a space to be air-conditioned based on an output from the object sensor 135 after a cooling process terminates, the controller 150 may perform a blowing process and a heating process sequentially by controlling the blower fan 160 and the compressor 170.

According to an embodiment, the controller 150 may perform a drying process by controlling the blower fan 160 and the compressor 170, according to an identification that no occupant exists in a space to be air-conditioned, based on at least one of information about a terminal connected to an access point or position information of the terminal.

For example, only in a case in which, after a cooling process terminates, the information about the terminal connected to the access point indicates that there is no terminal connected to the access point or the position information of the terminal indicates outside of the space to be air-conditioned, the controller 150 may perform the blowing process and the heating process sequentially by controlling the blower fan 160 and the compressor 170.

Also, the air conditioner 1 may identify a time at which it is identified that no occupant will exist, according to an output from a neural network trained based on a time at which a command for a drying process is received or a time at which it is identified that no occupant exists, and perform a drying process automatically at the identified time.

For this, the controller 150 may train the neural network by using at least one of a time at which a command for a drying process is received or a time at which it is identified that no occupant exists.

More specifically, the controller 150 may transfer a time at which a command for a drying process is received to the neural network. Also, the controller 150 may transfer a time at which it is identified that no occupant exists in the space to be air-conditioned based on an output from the objector sensor 135, to the neural network. Also, the controller 150 may transfer a time at which it is identified that no occupant exists in the space to be air-conditioned based on at least one of information about a terminal connected to the access point or position information of the terminal, to the neural network.

In this case, because the neural network indicates machine learning resulting from embodying a neural structure capable of performing deep learning, weights and biases corresponding to components of the neural network continue to change to improve the reliability of learning.

That is, the controller 150 may improve inference results of the neural network by continuing to update weights and biases corresponding to components of the neural network based on at least one of a time at which a command for a drying process is received or a time at which it is identified that no occupant exists.

Thereby, the neural network may output neural network output information including a time at which it is expected that no occupant will exist.

In this case, the neural network may be stored in a form of a computer program in the storage device 140. Hereinafter, an operation that is processed by a neural network will be described in a form of coding of a computer program. However, the neural network is not necessarily limited to a stored computer program. Also, according to an embodiment, the neural network may be provided in an external server, and in this case, the air conditioner 1 may transmit learning information to the external server through the communicator 120, and receive neural network output information from the external server through the communicator 120.

Meanwhile, the neural network may include a convolution neural network (CNN) that creates a features map output by convolving at least one of a time at which a command for a drying process is received or a time at which it is identified that no occupant exists, and inputs the features map to the neural network, although not limited thereto. However, another deep learning algorithm including recurrent neural networks (RNN) may be executed. That is, a kind of the neural network is not limited.

The controller 150 according to an embodiment may identify a time at which it is expected that no occupant will exist, based on an output (neural network output information) from the neural network, and perform a drying process by controlling the blower fan 160 and the compressor 170 at the identified time.

For example, the controller 170 may perform a blowing process and a heating process sequentially by controlling the blower fan 160 and the compressor 170 only at a time at which it is expected that no occupant will exist, based on an output (neural network output information) from the neural network, even after a cooling process terminates.

Also, the controller 150 may perform a dehumidifying process, a freezing process, a blowing process, and a heating process sequentially by controlling the blower fan 160 and the compressor 170 at a time at which it is expected that no occupant will exist based on an output (neural network output information) from the neural network, even in a case in which no cooling process is performed.

In a case in which the air conditioner 1 further includes an external indoor unit provided outside the housing 10 of the indoor unit 1*b*, the controller 150 according to an embodiment may stop a blower fan of the external indoor unit upon performing of a heating process of a drying process.

Also, in a case in which the air conditioner 1 further includes an external indoor unit provided outside the housing 10 of the indoor unit 1*b*, the controller 150 according to an embodiment may open an expansion valve of a refrigerant flow path connected to the external indoor unit by a preset ratio upon performing of a heating process of a drying process.

Performing a drying process in a case in which the air conditioner 1 includes the external indoor unit will be described in detail, below.

The controller may include at least one memory storing a program for performing the above-described operations and operations that will be described below, and at least one processor for executing the stored program. In a case in which a plurality of memories and a plurality of processors are provided, the plurality of memories and the plurality of processors may be integrated into a single chip or positioned at physically separated locations.

The blower fan 160 according to an embodiment may blow air heat-exchanged by the heat exchanger 30 to the main outlet 17 of the outlet panel 40.

More specifically, according to driving of the blower fan 160, outside air of the housing 10 may enter the inside of the housing 10 through the first inlet 12. The air entered the inside of the housing 10 may pass through the heat exchanger 30 to be heat-exchanged. The air heat-exchanged by passing through the heat exchanger 30 may pass through the blower fan 160, pass through the plurality of holes of the outlet panel 40 to be reduced in speed, and then be discharged to the outside of the housing 10 through the main outlet 17.

The blower fan 160 may operate by receiving power from the corresponding fan motor according to a control by the controller 150. For example, the blower fan 160 may operate during a cooling process, and also operate during a drying process.

The guide blower fan 165 according to an embodiment may blow outside air to receive the outside air and blow the outside air through the guide outlets 13 and 14.

More specifically, air may enter the inside of the housing 10 through the second inlet 15 by the guide blower fan 165. A part of the air entered through the second inlet 15 may move along the second flow path S2 to be discharged to the outside of the housing 10 through the first guide outlet 13, or move along the third flow path S3 to be discharged to the outside of the housing 10 through the second guide outlet 14.

The guide blower fan 165 may operate by receiving power from the corresponding fan motor, according to a control by the controller 150. For example, the guide blower fan 165 may operate during a cooling process. However, the guide blower fan 165 may stop according to a control by the controller 150 during a drying process.

The compressor 170 according to an embodiment may circulate a refrigerant on a refrigerant circulating circuit including the compressor 170, the 4-way valve 180, the outdoor heat exchanger 32, the expansion valve 190, and the heat exchanger 30, in response to a control signal from the controller 150. More specifically, the compressor 170 may compress a refrigerant in a gas state, and discharge a high-temperature/high-pressure gas refrigerant.

The compressor 170 may compress the refrigerant and discharge the refrigerant such that the refrigerant is condensed in the outdoor heat exchanger 32 and evaporated in the heat exchanger 30, during the cooling process.

Also, the compressor 170 may stop during a blowing process of a drying process, and compress a refrigerant and discharge the refrigerant during a dehumidifying process, a freezing process, and a heating process of the drying process.

The 4-way valve 180 may change a circulating direction of a refrigerant according to a control by the controller 150. More specifically, the 4-way valve 180 may guide the refrigerant compressed by the compressor 170 to the outdoor heat exchanger 32 during the cooling process, and during the heating process of the drying process, the 4-way valve 180 may guide the refrigerant compressed by the compressor 170 to the indoor unit 1*b*.

The expansion valve 190 may decompress a refrigerant, while adjusting an amount of a refrigerant to be provided to the outdoor heat exchanger 32 such that sufficient heat exchange occurs in the outdoor heat exchanger 32.

More specifically, the expansion valve 190 may decompress the refrigerant by using a throttling effect that a refrigerant passed through a narrow flow path is decompressed without any heat exchange with outside.

The expansion valve 190 may lower evaporation pressure in the heat exchanger 30 by narrowing a degree of opening during the freezing process, compared to during the dehumidifying process or the cooling process, thereby boiling the refrigerant.

As described above, the compressor 170, the 4-way valve 180, and the expansion valve 190 may be installed in the outdoor unit 1*a*, and the compressor 170, the 4-way valve 180, and the expansion valve 190 may be physically spaced far away from the controller 150 of the indoor unit 1*a*. Accordingly, the compressor 170, the 4-way valve 180, and the expansion valve 190 may communicate with the controller 150. Also, according to an embodiment, the controller 150 of the indoor unit 1*b* may transfer a control signal to the controller of the outdoor unit 1*a*, and the controller of the outdoor unit 1*a* may also transfer a control signal to the compressor 170, the 4-way valve 180, and the expansion valve 190.

So far, the individual components of the air conditioner 1 have been described in detail. Hereinafter, a drying process that is performed by the air conditioner 1 after the air conditioner 1 terminates a cooling process will be described in more detail.

Figure 7:
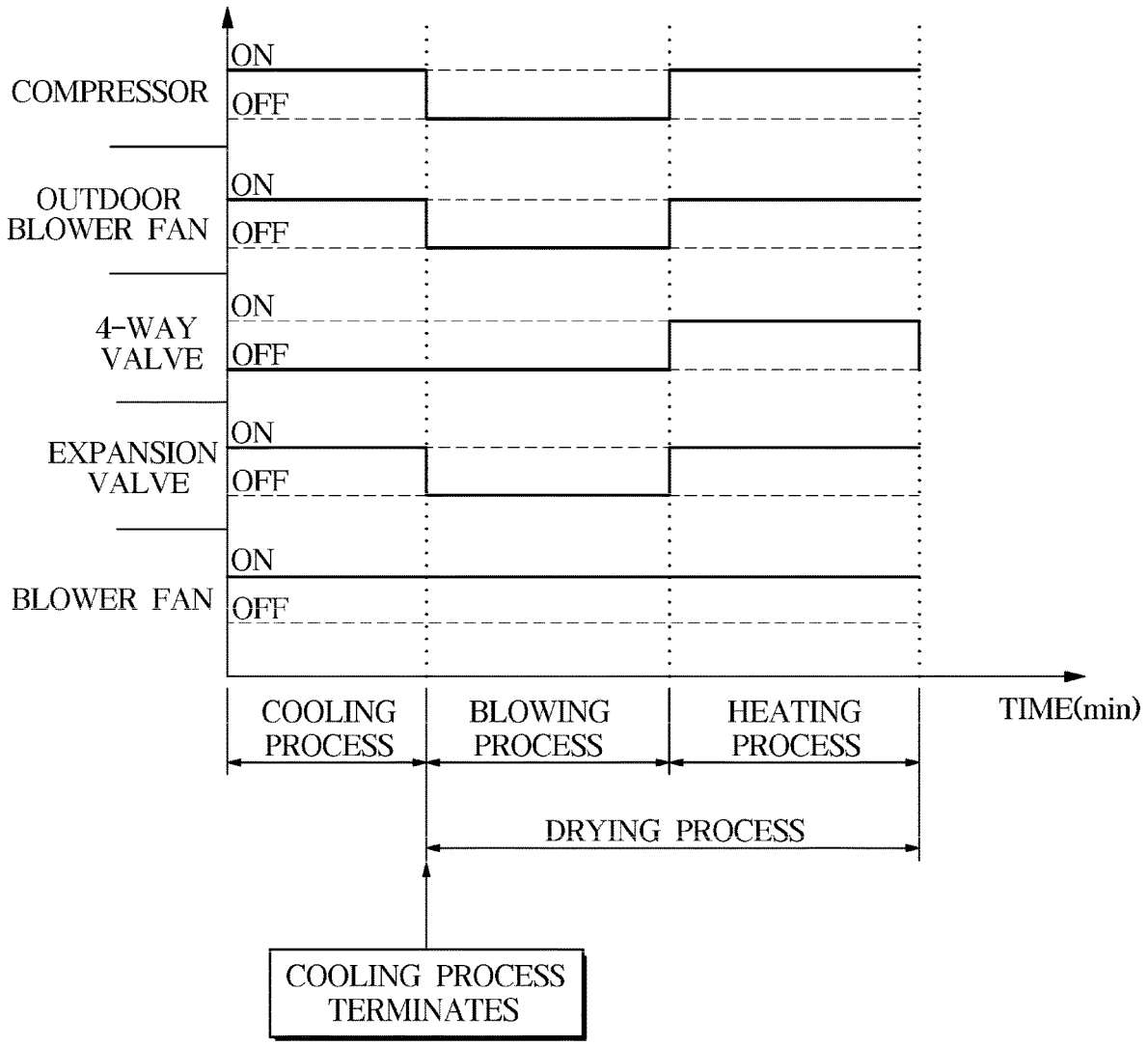
FIG. 7 is a view for describing a case in which an air conditioner according to an embodiment performs a drying process after a cooling process terminates.
Figure 8:
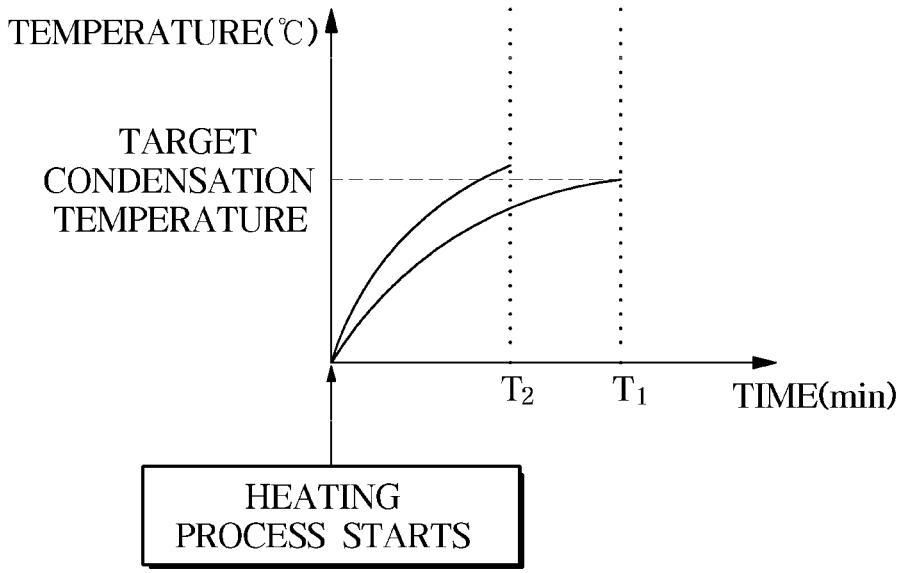
FIG. 8 is a view for describing a case in which an air conditioner according to an embodiment terminates a heating process of a drying process.
Figure 9:
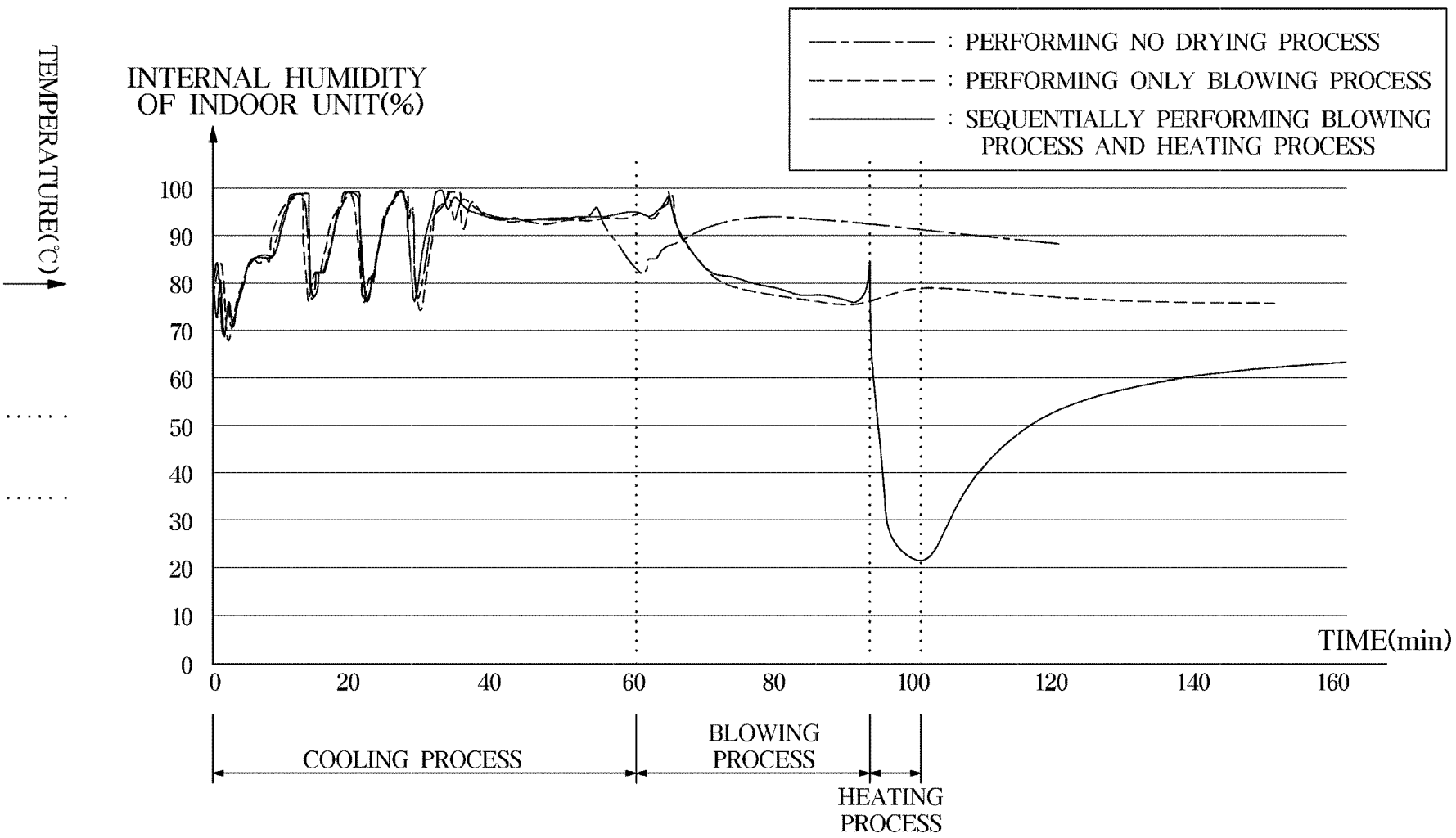
FIG. 9 is a view for describing changes in internal humidity of an indoor unit during a drying process of an air conditioner according to an embodiment.
Figure 10:
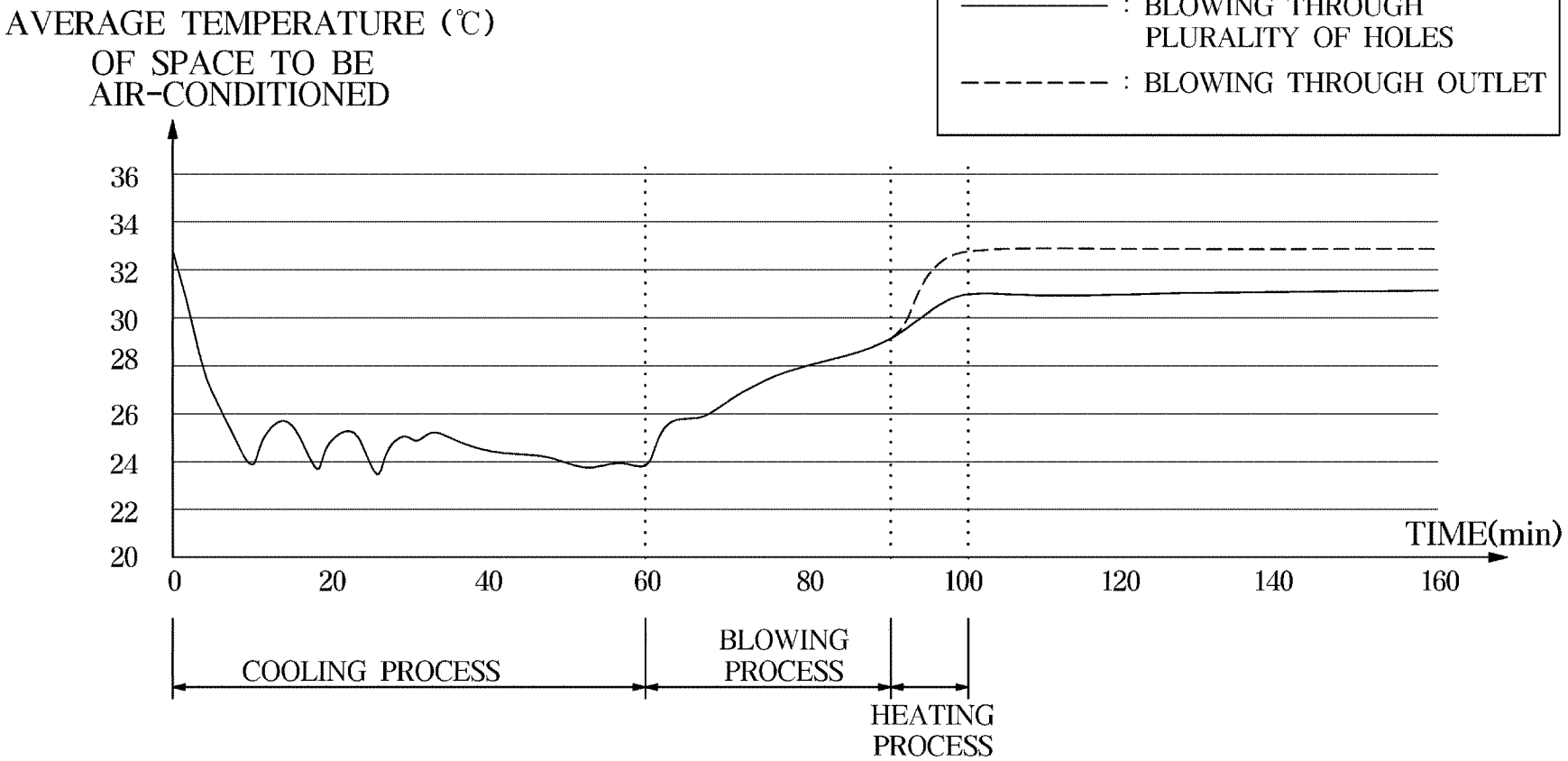
FIG. 10 is a view for describing changes in room temperature in a case in which an air conditioner according to an embodiment performs a drying process by blowing through a plurality of holes.
Figure 11:
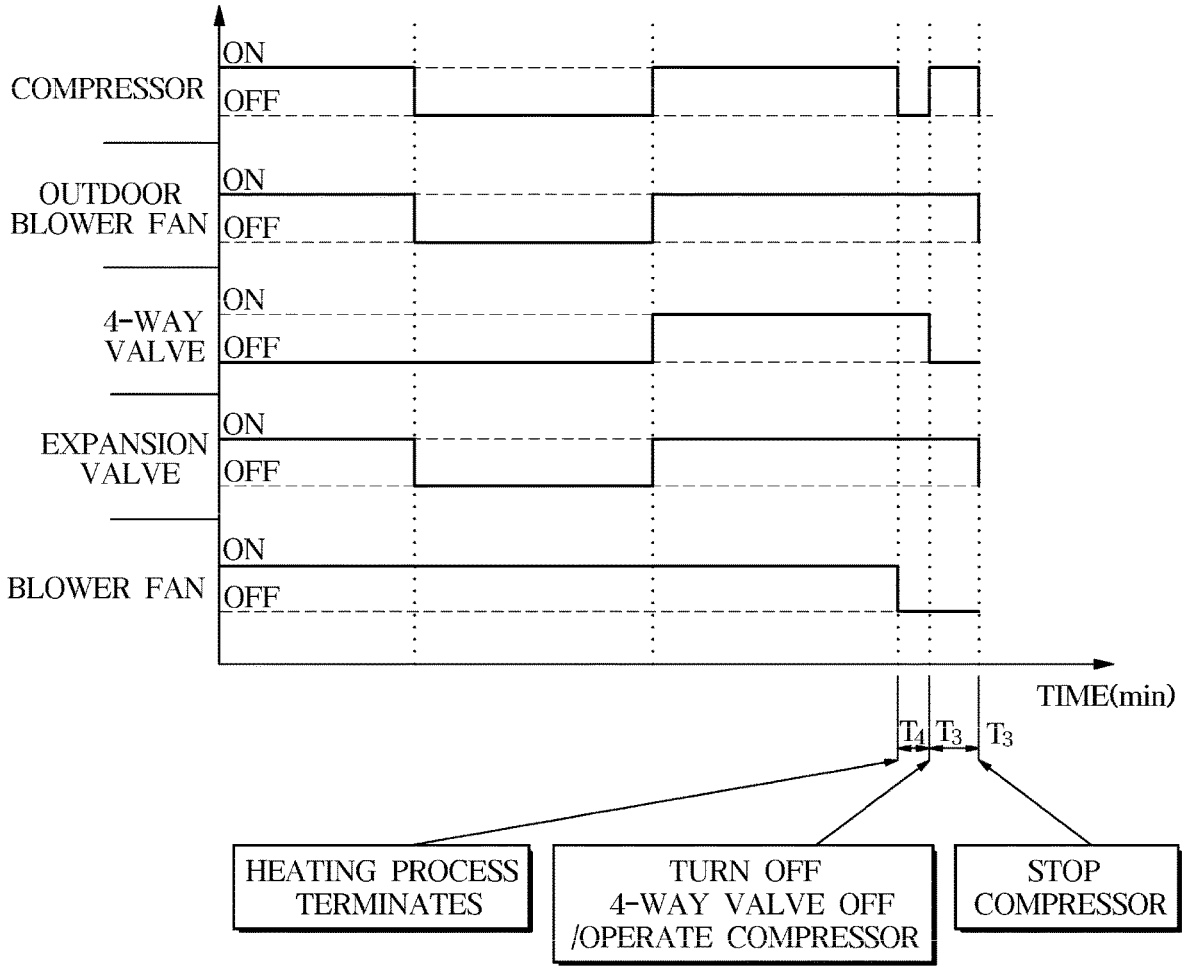
FIG. 11 is a view for describing a case in which an air conditioner according to an embodiment terminates a drying process by cooling an indoor heat exchanger after a heating process.

FIG. 7 is a view for describing a case in which the air conditioner 1 according to an embodiment performs a drying process after a cooling process terminates, FIG. 8 is a view for describing a case in which the air conditioner 1 according to an embodiment terminates a heating process of a drying process, FIG. 9 is a view for describing changes in internal humidity of the indoor unit 1*b* during a drying process of the air conditioner 1 according to an embodiment, FIG. 10 is a view for describing changes in room temperature in a case in which the air conditioner 1 according to an embodiment performs a drying process by blowing through a plurality of holes, FIG. 11 is a view for describing a case in which the air conditioner 1 according to an embodiment terminates a drying process by cooling the indoor heat exchanger 30 after a heating process.

Referring to FIG. 7, during a cooling process, the heat exchanger 30 may be cooled by a refrigerant, and upon contacting of air sucked through the first inlet 12 with the cooled heat exchanger 30, water may be condensed on the surface of the heat exchanger 30. Because the blower fan 160 blows air during the cooling process, the water condensed on the surface of the heat exchanger 30 may be collected in a drain container provided below the heat exchanger 30 by the blown air.

Upon stopping of the blower fan 160 after the cooling process terminates, water condensed on the heat exchanger 30 may be no longer removed. Water condensed on the first inlet 12, the main outlet 17, and the outlet panel 40, as well as the heat exchanger 30, may also be no longer removed. Due to the water, microbes may propagate on the heat exchanger 30, the first inlet 12, the main outlet 17, the outlet panel 40, and accordingly, stain may be generated and an odor may be created.

To prevent these, the air conditioner 1 may perform a drying process for drying condensed water on the surface of the heat exchanger 30 after the cooling process terminates.

The drying process may include a blowing process of operating the blower fan 160 in a state of stopping the compressor 170, and a heating process of changing a circulating direction of a refrigerant with the 4-way valve 180 while operating both the compressor 170 and the blower fan 160.

For this, the controller 150 according to an embodiment may perform the drying process after the cooling process terminates. More specifically, the controller 150 may perform the blowing process and the heating process sequentially by controlling the blower fan 160 and the compressor 170.

The controller 150 may dry the condensed water on the surface of the heat exchanger 30 by turning on only the blower fan 160 in a state of turning off the compressor 170 for a preset blowing process time (for example, 30 minutes) to blow air to the heat exchanger 30.

That is, the controller 150 may turn off the compressor 170, the outdoor blower fan (not shown), the 4-way valve 180, and the expansion valve 190 during the blowing process such that refrigerant circulation stops and thus no heat exchange occurs in the heat exchanger 30.

At the same time, the controller 150 may operate the blower fan 160 such that outside air of the housing 10 enters the inside of the housing 10 through the first inlet 12, passes through the heat exchanger 30, passes through the plurality of holes of the outlet panel 40 to be reduced in speed, and then is discharged to the outside of the housing 10.

As such, because outside air passes through the heat exchanger 30 by the blowing process, condensed water condensed on the surface of the heat exchanger 30 by the cooling process may be dried. Also, water condensed on the inside of the indoor unit 1*b*, such as the first inlet 12, the main outlet 17, the outlet panel 40, etc., as well as the heat exchanger 30, may also be removed.

However, in a case in which room air has high humidity, there may be difficulties in reducing internal humidity of the heat exchanger 30 and the indoor unit 1*b* to lower humidity than humidity of the room air through the blowing process. As a result, there may be difficulties in completely removing condensed water on the heat exchanger 30 and inside the indoor unit 1*b* by the blowing process.

Accordingly, the controller 150 according to an embodiment may perform a heating process upon termination of the blowing process.

That is, the controller 150 may change a circulating direction of a refrigerant by turning on the 4-way valve 180, and then turn on the blower fan 160 and the compressor 170 for a preset heating process time (for example, 10 minutes) to condense the refrigerant in the heat exchanger 30 and transfer heat to the condensed water on the surface of the heat exchanger 30. Thereby, the condensed water on the surface of the heat exchanger 30 may be completely dried. The heating process time may be set to a shorter time than the blowing process time.

According to an embodiment, the controller 150 may terminate the heating process according to an identification that a preset heating process time $T_1$ has elapsed after the heating process starts or that condensation temperature in the heat exchanger 30 is higher than or equal to target condensation temperature ($T_2$) after the heating process starts, as shown in FIG. 8. For example, the controller 150 may terminate the heating process according to an identification that condensation temperature of a refrigerant is maintained for a preset time at the target condensation temperature. Thereby, the air conditioner 1 may prevent room temperature from rising excessively due to an excessive heating process.

During the heating process of the drying process, the controller 150 may control the 4-way valve 180 to guide a refrigerant discharged from the compressor 170 to the heat exchanger 30 of the indoor unit 1*b*. Also, the controller 150 may turn on the compressor 170, the outdoor blower fan (not shown), the expansion valve 190, and the blower fan 160 such that the refrigerant is evaporated in the outdoor heat exchanger 32 and the refrigerant is condensed in the heat exchanger 30.

As such, in a case in which the heating process is performed during the drying process, the controller 150 may completely dry condensed water remaining on the surface of the heat exchanger 30 despite the blowing process by generating heat according to the condensation of the refrigerant in the heat exchanger 30.

That is, internal humidity of the indoor unit 1*b* may be low in a case in which the heating process is performed, compared to a case in which the drying process is not performed or a case in which only the blowing process is performed without performing the heating process, as shown in FIG. 9.

Through the drying process, internal humidity of the indoor unit 1*b* may become lower than room humidity, and condensed water may be more actively evaporated. The controller 150 may completely dry condensed water on the surface of the heat exchanger 30 by operating the blower fan 160 in a state in which internal humidity of the indoor unit 1*b* becomes low due to heat of the heat exchanger 30.

Also, by the low internal humidity of the indoor unit 1*b* and blowing of air heat-exchanged in the heat exchanger 30, water condensed on the inside of the indoor unit 1*b*, such as the first inlet 12, the main outlet 17, the outlet panel 40, etc., as well as the heat exchanger 30, may also be completely removed.

As such, because the air conditioner 1 according to an embodiment includes a heating process in which a refrigerant is condensed in the heat exchanger 30 as one stage of a drying process, heat may be emitted from the surface of the heat exchanger 30 and thus, condensed water may be completely dried.

Also, the air conditioner 1 according to an embodiment may operate in the first mode during the drying process for drying condensed water on the surface of the heat exchanger 30. That is, during the drying process, the guide blower fan 165 may stop, and blowing of air through the guide flow paths S2 and S3 may be limited.

Thereby, air heat-exchanged by the heating process may be discharged to an indoor space only through the plurality of holes of the outlet panel 40. Accordingly, a less amount of heat may diffuse to the indoor space than in a case in which air is discharged through the guide outlets 13 and 14, and the drying process may be performed with low noise.

That is, average temperature of the space to be air-conditioned may be lower in a case in which a heating process of blowing air through the plurality of holes is performed, than in a case in which a heating process of blowing air through the outlets 13 and 14 is performed, as shown in FIG. 10.

As such, the air conditioner 1 may have less influence on temperature of a space to be air-conditioned while efficiently drying condensed water by blowing air only through the plurality of holes of the outlet panel 40 during a drying process. Thereby, a user may be prevented from feeling uncomfortable due to rising room temperature by the drying process.

Meanwhile, according to another embodiment, in a case in which the indoor unit 1*b* further includes at least one outlet positioned in the portion of the front panel 16 in which the main outlet 17 is formed, and a door for opening or closing the outlet, the air conditioner 1 according to an embodiment may control the door to close the outlet such that the air conditioner 1 operates in the first mode during a drying process for drying condensed water on the surface of the heat exchanger 30. Thereby, air heat-exchanged by a heating process may be discharged to an indoor space only through the plurality of holes of the outlet panel 40. Accordingly, a less amount of heat may diffuse to the indoor space than in a case in which air is discharged through the outlet, and the drying process may be performed with low noise. That is, the indoor unit 1*b* may close the outlet exposed to the outside of the housing 10 to change a flow path of air entered the first inlet 12 and cause the air to be reduced in speed and discharged through the plurality of holes of the outlet panel 40.

As a result, the controller 150 may perform a control operation of discharging air only through the plurality of holes of the outlet panel 40 during the drying process. More specifically, the controller 150 may block power to be supplied to the guide blower fan 165 or control the door actuator to close the outlet such that air is discharged only through the plurality of holes of the outlet panel 40.

However, according to an embodiment, in a case in which the indoor unit 1*b* does not include the outlet panel 40 and the main outlet 17 is exposed to the outside of the housing 10, the air conditioner 1 may perform the drying process by moving air through the main outlet 17. That is, the air conditioner 1 may perform the drying process by controlling the blower fan 160 and the compressor 170 to cause air entered the first inlet 12 to pass through the heat exchanger 30 and be discharged to the indoor space through the main outlet 17. Thereby, the air conditioner 1 may dry condensed water of the heat exchanger 30.

Also, the controller 150 according to an embodiment may operate the compressor 170 for a preset operation time $T_3$ (for example, 30 seconds) such that a refrigerant is evaporated in the heat exchanger 30 after the heating process terminates, as shown in FIG. 11. The operation time $T_3$ may be set to a shorter time than the heating process time.

That is, the controller 150 may turn on the compressor 170, the outdoor blower fan, the 4-way valve 180, and the expansion valve 190 for the preset operation time $T_3$ such that the heat exchanger 30 operates as an evaporator. However, the controller 150 may turn off the blower fan 160 for the preset time period $T_3$ to prevent heat from diffusing to the space to be air-conditioned.

Thereby, the heat exchanger 30 may be cooled, and heat of the heat exchanger 30, generated by the heating process, may be removed to prevent heat from diffusing to the space to be air-conditioned after the heating process. Accordingly, a user may be prevented from feeling uncomfortable due to rising room temperature by the drying process.

Also, according to an embodiment, the controller 150 may stop the compressor 170 upon termination of the heating process, turn off the 4-way valve 180 to change a circulating direction of a refrigerant to a circulating direction for the cooling process in a case in which a preset switching time $T_4$ elapses after the heating process terminates, and operate the compressor 170 for the preset operation time $T_3$ after the 4-way valve 180 is turned off.

As such, according to an embodiment, the air conditioner 1 may stop the compressor 170 for the switching time $T_4$ after the heating process terminates to maintain pressure of the refrigerant at pressure equilibrium, and then switch the 4-way valve 180, thereby preventing noise that is generated upon switching of the 4-way valve 180.

So far, a case in which the air conditioner 1 performs a drying process including a blowing process and a heating process after terminating a cooling process has been described in detail. Hereinafter, a case in which the air conditioner 1 performs a drying process by receiving a command for a drying process from a user to will be described in detail.

Figure 12:
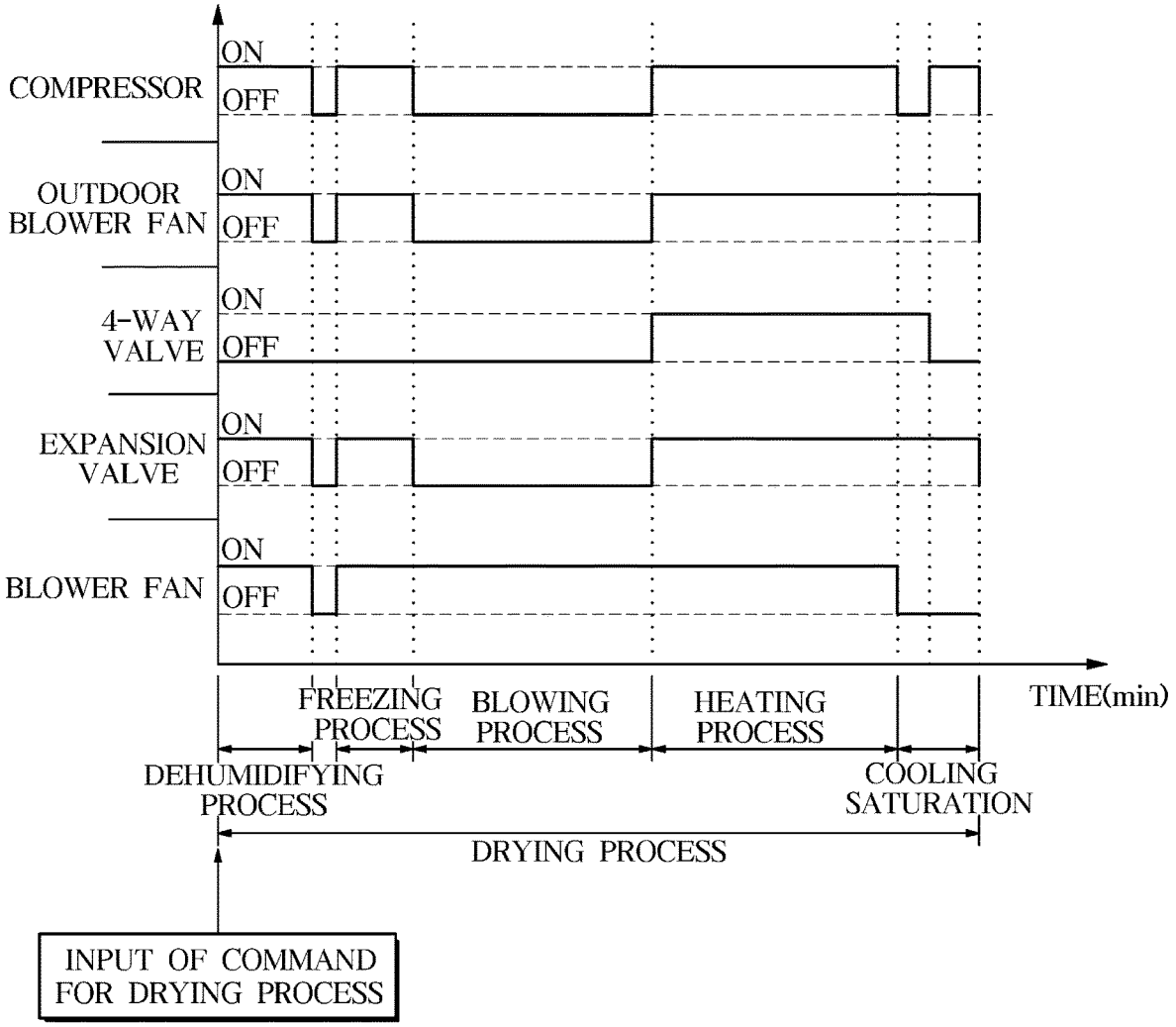
FIG. 12 is a view for describing a case in which an air conditioner according to an embodiment performs a drying process according to a user input.

FIG. 12 is a view for describing a case in which the air conditioner 1 according to an embodiment performs a drying process according to a user input.

Referring to FIG. 12, upon reception of a command for a drying process from a user through the inputter 110, the controller 150 according to an embodiment may perform a dehumidifying process and a freezing process sequentially by controlling the blower fan 160 and the compressor 170 and perform a blowing process and a heating process sequentially by controlling the blower fan 160 and the compressor 170 after the freezing process terminates.

That is, in a case in which the controller 150 performs a drying process by receiving a command for a drying process through the inputter 110, compared to a case of performing a drying process after a cooling process terminates, the controller 150 may preferentially perform a dehumidifying process and a freezing process before a blowing process and a heating process. As such, the controller 150 may forcedly generate condensed water on the surface of the heat exchanger 30 by preferentially performing the dehumidifying process and the freezing process, and then perform the blowing process and the heating process sequentially.

More specifically, the controller 150 may operate the blower fan 160, the compressor 170, the outdoor blower fan, and the expansion valve 190 for a preset dehumidifying process time (for example, 15 minutes) such that the heat exchanger 30 operates as an evaporator. At this time, as the heat exchanger 30 is cooled, condensed water may be generated on the surface of the heat exchanger 30.

Also, according to an embodiment, the controller 150 may stop the blower fan 160 and the compressor 170 for a preset stop time (for example, 3 minutes) before a freezing process is performed after the dehumidifying process terminates. Thereby, a part of the condensed water generated on the surface of the heat exchanger 30 may flow down and be collected in the drain container provided below the heat exchanger 30.

After the dehumidifying process terminates, the controller 150 may operate the blower fan 160 and the compressor 170 for a preset freezing process time (for example, 15 minutes) to freeze the heat exchanger 30. That is, the controller 150 may operate the blower fan 160, the compressor 170, the outdoor blower fan, and the expansion valve 190 such that the heat exchanger 30 operates as an evaporator.

More specifically, the controller 150 may adjust target evaporation temperature of a refrigerant in the heat exchanger 30 to lower temperature to lower temperature of the surface of the heat exchanger 30 to a freezing point such that condensed water on the surface of the heat exchanger 30 is frozen as ice capsules.

Also, the controller 150 may adjust at least one of rpm of the blower fan 160, an operating frequency of the compressor 170, or a degree of opening of the expansion valve 190 such that the refrigerant is evaporated at the target evaporation temperature.

That is, the controller 150 may control the blower fan 160 such that rpm of the blower fan 160 during the freezing process is lower than rpm during the dehumidifying process (cooling process). Thereby, heat-exchange capability of the heat exchanger 30 may be improved, and a flow velocity of air on the surface of the heat exchanger 30 may be lowered to accumulate energy. Accordingly, evaporation temperature of the heat exchanger 30 may be lowered, and condensed water on the surface of the heat exchanger 30 may be frozen.

Also, the controller 150 may control the compressor 170 such that an operating frequency of the compressor 170 during the freezing process is higher than operating frequency during the dehumidifying process (cooling process). Thereby, heat-exchange capability of the heat exchanger 30 may be improved, and evaporation temperature of the heat exchanger 30 may be lowered, and thus, condensed water on the surface of the heat exchanger 30 may be frozen.

Also, the controller 150 may narrow a degree of opening of the expansion valve 190 such that a flow rate of a refrigerant during the freezing process is lower than a flow rate of a refrigerant during the dehumidifying process (cooling process). Thereby, evaporation pressure may be lowered to boil the refrigerant and absorb heat, and as surface temperature of the heat exchanger 30 is lowered, evaporation temperature of the heat exchanger 30 may be lowered.

As such, while the air conditioner 1 performs the freezing process, the condensed water on the surface of the heat exchanger 30 may be frozen, and contaminants, such as dust, foreign materials, etc., existing on the surface of the heat exchanger 30 may be detached from the surface of the heat exchanger 30 by the frozen, condensed water.

After the freezing process terminates, the controller 150 may perform a blowing process of blowing air to the heat exchanger 30 by operating the blower fan 160 in a state of stopping the compressor 170. The frozen, condensed water may melt through the blowing process, and the contaminants may be naturally discharged from the heat exchanger 30 together with the melt, condensed water.

After the blowing process terminates, the controller 150 may perform a heating process by controlling the blower fan 160 and the compressor 170. At this time, according to an embodiment, the controller 150 may adjust target condensation temperature to higher temperature to supply higher heat to the heat exchanger 30 than in a drying process that is performed according to termination of a cooling process.

As such, the air conditioner 1 may perform the blowing process and the heating process sequentially after the freezing process to dry the condensed water while removing the contaminants from the heat exchanger 30.

Also, like a case in which a drying process is performed after a cooling process terminates, the controller 150 may operate the compressor 170 for the preset operation time $T_3$ (for example, 30 seconds) after the heating process terminates such that a refrigerant is evaporated in the heat exchanger 30 (cooling saturation).

However, according to an embodiment, upon reception of a command for a drying process from a user through the inputter 110, the air conditioner 1 may perform a dehumidifying process, a blowing process, and a heating process sequentially without performing a freezing process. That is, the controller 150 may perform a blowing process and a heating process sequentially without performing a freezing process, after a dehumidifying process terminates.

In other words, upon reception of a command for a drying process from a user through the inputter 110, the drying process may include a dehumidifying process, a freezing process, a blowing process, and a heating process, or the drying process may include a dehumidifying process, a blowing process, and a heating process, according to embodiments.

The controller 150 may operate only the blower fan 160 and stop the guide blower fan 165 to discharge air only through the plurality of holes during the drying process. That is, the controller 150 may perform a control operation of supplying power only to the fan motor corresponding to the blower fan 160 while blocking power to be supplied to the fan motor corresponding to the guide blower fan 165.

Meanwhile, according to another embodiment, in a case in which the indoor unit 1*b* further includes at least one outlet positioned in the portion of the front panel 16 in which the main outlet 17 is formed, and a door for opening or closing the outlet, the controller 150 may operate the blower fan 160 while controlling the door to close the outlet, during the drying process, to discharge air only through the plurality of holes. That is, the indoor unit 1*b* may change a flow path of air entered the first inlet 12 by closing the outlet exposed to the outside of the housing 10 such that the air is reduced in speed and discharged through the plurality of holes of the outlet panel 40.

However, according to an embodiment, the indoor unit 1*b* may perform the drying process in a state of opening the outlet. More specifically, according to an embodiment, upon reception of a command for a drying process from a user through the inputter 110, the controller 150 may perform the drying process in a state of controlling the door actuator to open the outlet.

Meanwhile, according to another embodiment, in a case in which the indoor unit 1*b* does not include the outlet panel 40 and the main outlet 17 is exposed to the outside of the housing 10, the air conditioner 1 may perform the drying process by moving air through the main outlet 17. That is, the air conditioner 1 may perform the drying process by controlling the blower fan 160 and the compressor 170 such that air entered the first inlet 12 passes through the heat exchanger 30 and is discharged to an indoor space through the main outlet 17. Thereby, the air conditioner 1 may dry condensed water of the heat exchanger 30.

So far, a case in which the air conditioner 1 performs a drying process by receiving a command for a drying process from a user has been described in detail. Hereinafter, a case in which the air conditioner 1 performs a drying process according to whether an occupant exists in a space to be air-conditioned will be described in detail.

Figure 13:
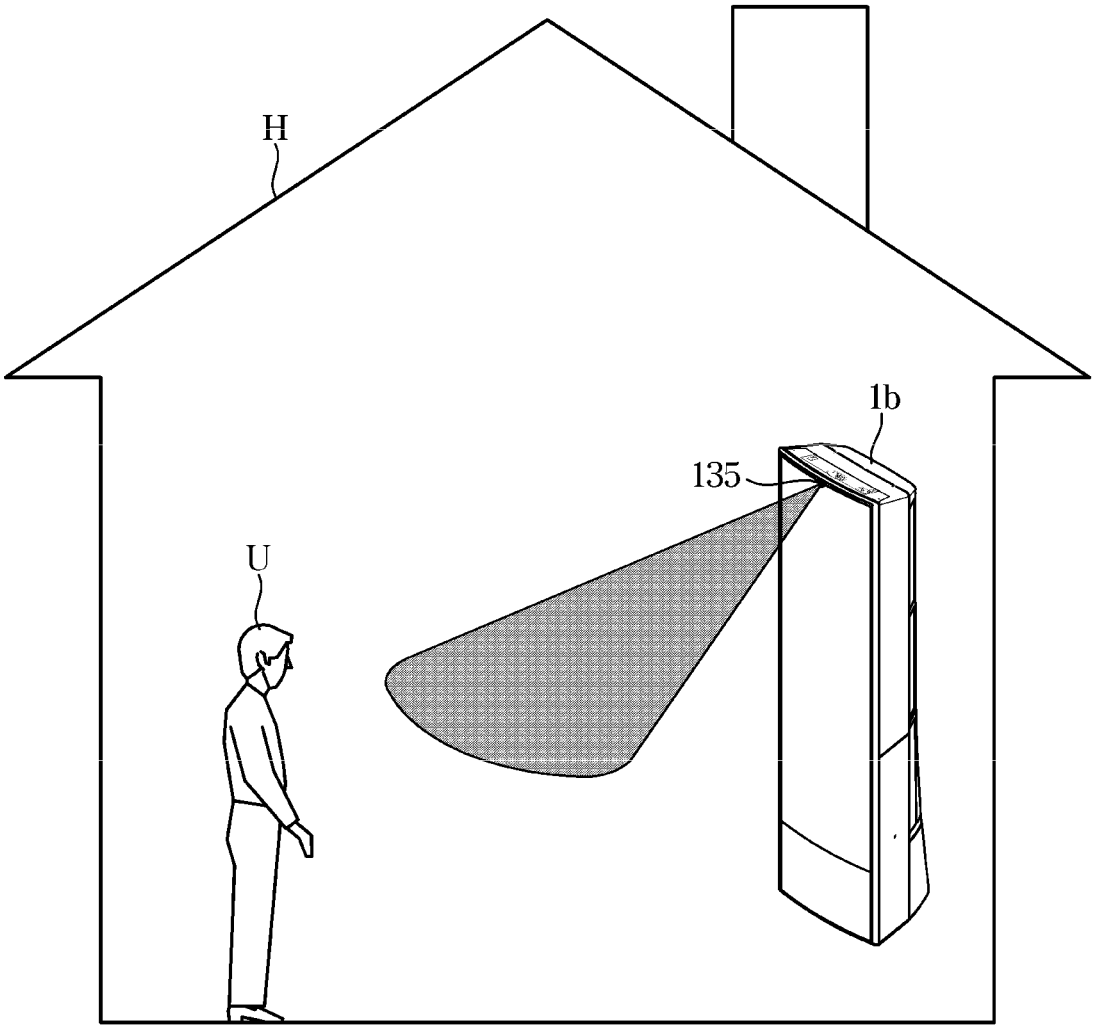
FIG. 13 is a view for describing a case in which an air conditioner according to an embodiment identifies whether an occupant exists according to an output from an object sensor and performs a drying process.
Figure 14:
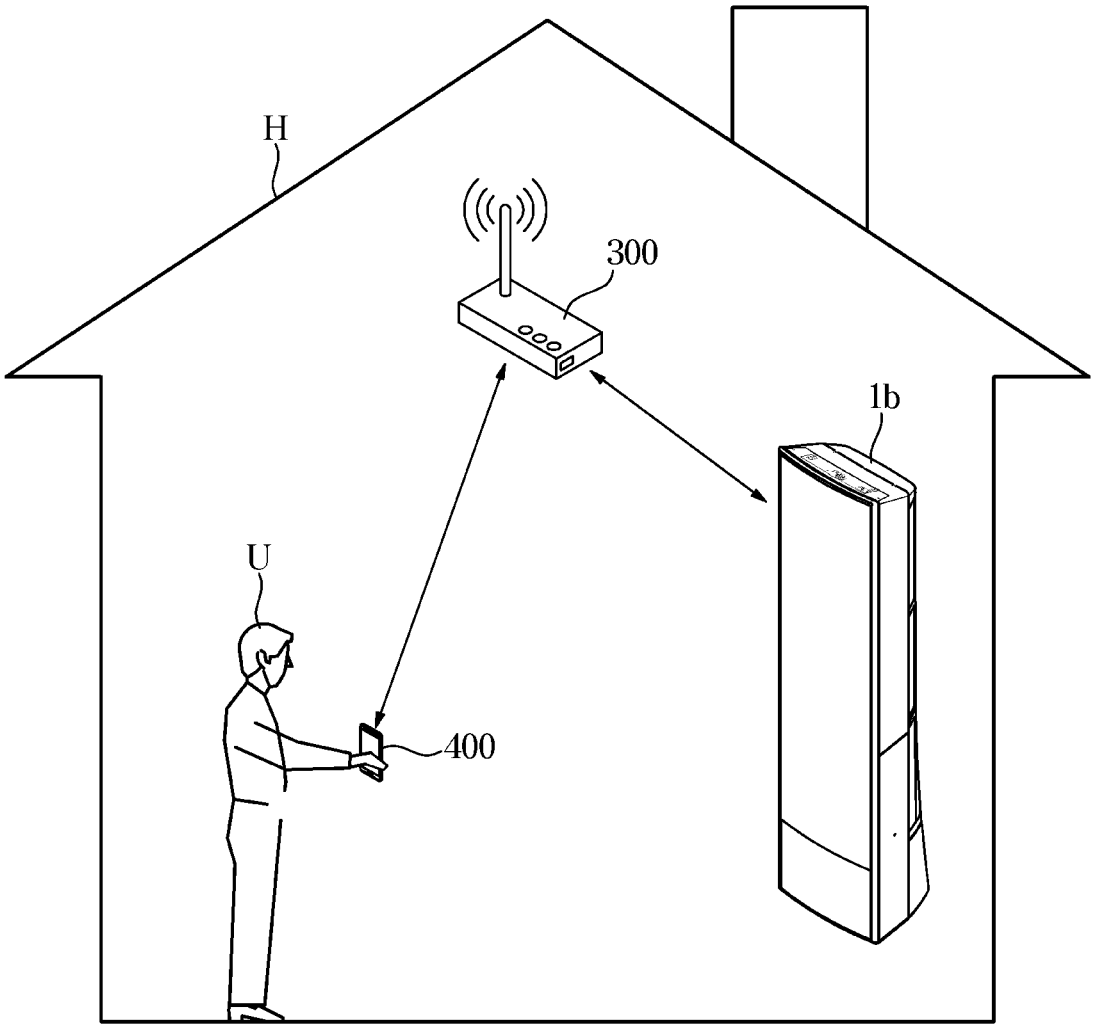
FIG. 14 is a view for describing a case in which an air conditioner according to an embodiment identifies whether an occupant exists according to a location of a terminal and performs a drying process.

FIG. 13 is a view for describing a case in which the air conditioner 1 according to an embodiment identifies whether an occupant exists according to an output from the object sensor 135 and performs a drying process, and FIG. 14 is a view for describing a case in which the air conditioner 1 according to an embodiment identifies whether an occupant exists according to a location of a terminal and performs a drying process.

Referring to FIGS. 13 and 14, the controller 150 according to an embodiment may identify whether to perform a drying process based on whether an occupant U exists in a space H to be air-conditioned.

The controller 150 may perform the drying process by controlling the blower fan 160 and the compressor 170, according to an identification that no occupant exists in the space H to be air-conditioned based on an output from the object sensor 135, as shown in FIG. 13.

According to an embodiment, in a case in which no occupant U is detected for a preset time (for example, 30 minutes) through the object sensor 135, the controller 150 may determine that no occupant U exists in the space H to be air-conditioned.

For example, only in a case in which it is identified that no occupant U exists in the space H to be air-conditioned based on an output from the object sensor 135 even after a cooling process has terminated, the controller 150 may perform a blowing process and a heating process sequentially by controlling the blower fan 160 and the compressor 170.

Also, according to an identification that no occupant U exists in the space H to be air-conditioned based on at least one of information about a terminal 400 connected to an access point 300 or position information of the terminal 400, the controller 150 may perform the drying process by controlling the blower fan 160 and the compressor 170, as shown in FIG. 14.

The access point 300 may be positioned inside the space H to be air-conditioned, and connect the air conditioner 1 and the terminal 400 positioned in the space H to be air-conditioned to a network (a wide area communication network). That is, the air conditioner 1 and the terminal 400 positioned inside the space H to be air-conditioned may be connected to a network through the access point 300. For this, the access point 300 may include a wireless communication module, such as wireless fidelity (WiFi), Bluetooth, Bluetooth low energy (BLE), zigbee, near field communication (NFC), Wibro, etc., and a wired communication module, such as LAN, WAN, etc.

The terminal 400 which a user U possesses may be an electronic device that is portable and movable, and may be a video phone, a mobile phone, a smart phone, a wideband code division multiple access (WCDMA) user terminal, a universal mobile telecommunication service (UMTS) user terminal, a personal digital assistant (PDA), a portable multimedia player (PMP), a digital multimedia broadcasting (DMB) user terminal, E-Book, a laptop computer (a notebook, a tablet, etc.), a digital camera, etc.

In this case, the terminal 400 may connect to the wide area communication network by connecting to the access point 300 in the space H to be air-conditioned according to a location of the user U possessing the terminal 400, and may connect to the wide area communication network through a separate communication service (for example, LTE, LTE Advance (LTE-A), code division multiple access (CDMA), wideband CDMA (WCDMA), universal mobile telecommunications system (UMTS), wireless broadband (Wibro), global system for mobile communications (GSM), etc.).

The controller 150 may receive information about the terminal 400 connected to the access point 300 from the access point 300 through the communicator 120. The information about the terminal 400 connected to the access point 300 may include identification information of the terminal 400 located in the space H to be air-conditioned and connected to the access point 300. The controller 150 may identify that no occupant U exists in the space H to be air-conditioned, in a case in which the information about the terminal 400 connected to the access point 300 indicates that there is no terminal 400 connected to the access point 300.

Also, the controller 150 may receive position information (for example, a global positioning system (GPS) signal) of the terminal 400 from the terminal 400 through the communicator 120. That is, the controller 150 may receive position information of the terminal 400 from the terminal 400 connected to the network through a separate communication service, and identify that no occupant U exists in the space H to be air-conditioned, in a case in which the position information of the terminal 400 indicates that the terminal 400 is positioned outside the space H to be air-conditioned.

For example, only in a case in which information about the terminal 400 connected to the access point 300 indicates that there is no terminal 400 connected to the access point 300 even after a cooling process terminates or in a case in which position information of the terminal 400 indicates the outside of the space H to be air-conditioned, the controller 150 may perform a blowing process and a heating process sequentially by controlling the blower fan 160 and the compressor 170.

As such, the air conditioner 1 may perform a drying process in a case in which no occupant U exists in the space H to be air-conditioned, thereby preventing a user from feeling uncomfortable due to changes in temperature and humidity of the space H to be air-conditioned according to the drying process.

Also, the air conditioner 1 may identify a time at which it is identified that no occupant U will exist, based on an output from a neural network trained based on a time at which a command for a drying process is received or a time at which it is identified that no occupant U exists, and perform a drying process automatically at the identified time.

For this, the controller 150 may train the neural network by using at least one of a time at which a command for a drying process is received or a time at which it is identified that no occupant U exists.

More specifically, the controller 150 may transfer a time at which a command for a drying process is received to the neural network. Also, the controller 150 may transfer a time at which it is identified that no occupant U will exist in the space H to be air-conditioned, based on an output from the object sensor 135, to the neural network. Also, the controller 150 may transfer a time at which it is identified that no occupant U exists in the space H to be air-conditioned, based on at least one of information about the terminal 400 connected to the access point 300 or position information of the terminal 400, to the neural network.

In this case, because the neural network indicates machine learning resulting from embodying a neural structure capable of performing deep learning, weights and biases corresponding to components of the neural network continue to change to improve the reliability of learning.

That is, the controller 150 may improve inference results of the neural network by continuing to update weights and biases corresponding to components of the neural network based on at least one of a time at which a command for a drying process is received or a time at which it is identified that no occupant exists.

Thereby, the neural network may output neural network output information including a time at which it is expected that no occupant will exist.

In this case, the neural network may be stored in a form of a computer program in the storage device 140. Hereinafter, an operation that is processed by a neural network will be described in a form of coding of a computer program. However, the neural network is not necessarily limited to a stored computer program. Also, according to an embodiment, the neural network may be provided in an external server, and in this case, the air conditioner 1 may transmit learning information to the external server through the communicator 120, and receive neural network output information from the external server through the communicator 120.

Meanwhile, the neural network may include a convolution neural network (CNN) that creates a features map output by convolving at least one of a time at which a command for a drying process is received or a time at which it is identified that no occupant exists, and inputs the features map to the neural network, although not limited thereto. However, another deep learning algorithm including recurrent neural networks (RNN) may be executed. That is, a kind of the neural network is not limited.

The controller 150 according to an embodiment may identify a time at which it is expected that no occupant will exist, based on an output (neural network output information) from the neural network, and perform a drying process by controlling the blower fan 160 and the compressor 170 at the identified time.

For example, the controller 170 may perform the blowing process and the heating process sequentially by controlling the blower fan 160 and the compressor 170 only at the time at which it is expected that no occupant will exist, based on an output (neural network output information) from the neural network, even after a cooling process terminates.

Also, the controller 150 may perform a dehumidifying process, a freezing process, a blowing process, and a heating process sequentially by controlling the blower fan 160 and the compressor 170 at the time at which it is expected that no occupant will exist, based on an output (neural network output information) from the neural network, even in a case in which no cooling process is performed.

So far, performing a drying process according to whether an occupant U exists has been described in detail. Hereinafter, performing a drying process in a case in which the air conditioner 1 includes a plurality of indoor units will be described in detail.

Figure 15:
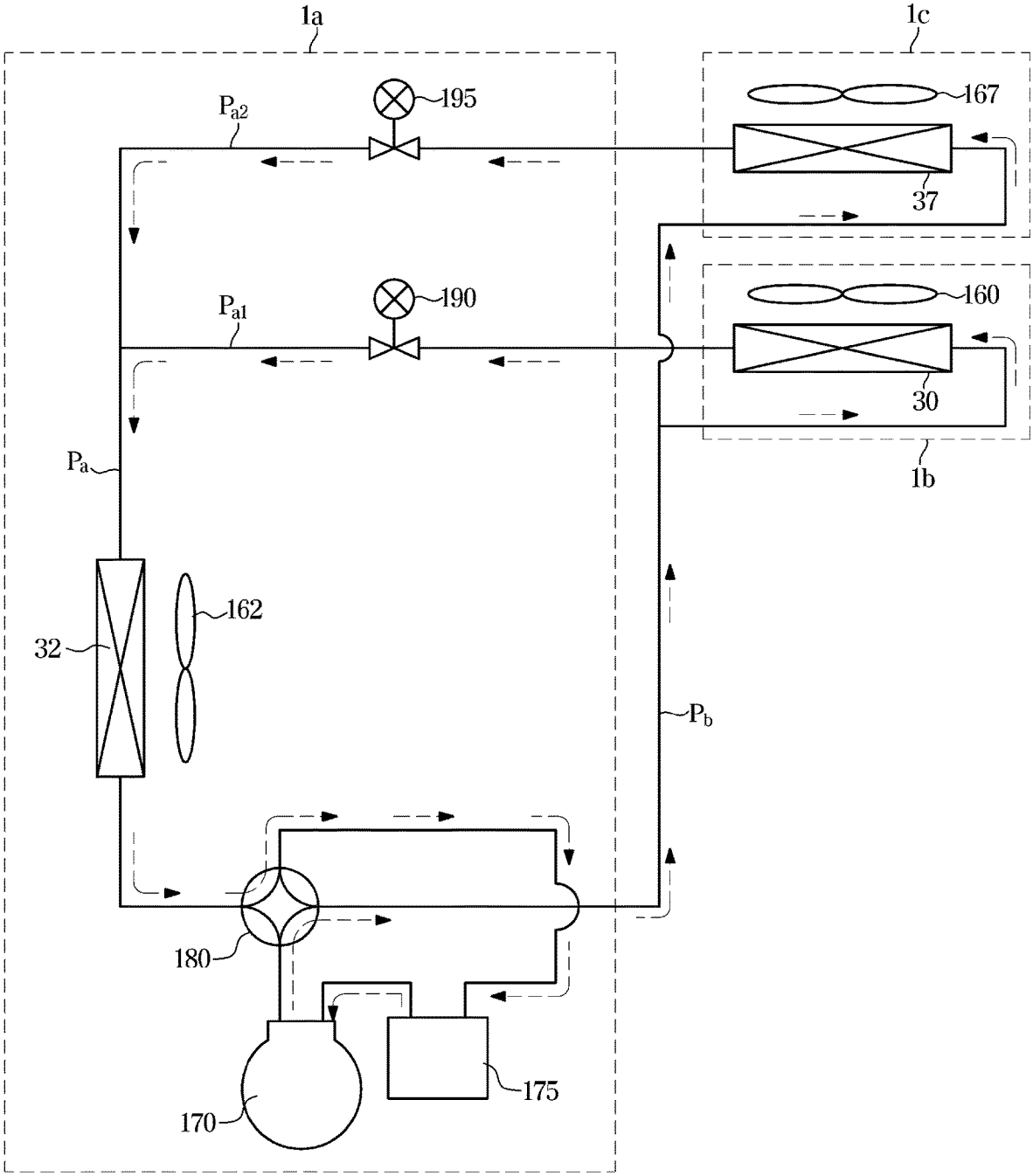
FIG. 15 is a view showing a case in which an air conditioner according to an embodiment includes a plurality of indoor units and performs a heating process.

FIG. 15 is a view for describing a case in which the air conditioner 1 according to an embodiment includes a plurality of indoor units and performs a heating process.

Referring to FIG. 15, the air conditioner 1 according to an embodiment may include a plurality of indoor units 1*b* and 1*c*. That is, the air conditioner 1 may further include an external indoor unit 1*c* provided outside the housing 10 of the indoor unit 1*b*. For example, the external outdoor unit 1*c* may be a wall-mounted air conditioner that is installed in a room. FIG. 15 shows a case in which a single external outdoor unit 1*c* is provided. However, the number of the external outdoor unit 1*c* is not limited.

The plurality of indoor units 1*b* and 1*c* may be connected in parallel to a single outdoor unit 1*a*. More specifically, a refrigerant flow path Pa connected to the outdoor heat exchanger 32 may diverge to connect to the heat exchanger 30 of the indoor unit 1*b* and a heat exchanger 37 of the external indoor unit 1*c*, respectively. Also, a refrigerant flow path Pb connected to the 4-way valve 180 may also diverge to connect to the heat exchanger 30 of the indoor unit 1*b* and the external heat exchanger 37 of the external indoor unit 1*c*, respectively.

In this case, the refrigerant flow path Pa connected to the outdoor heat exchanger 32 may diverge to a first refrigerant flow path Pa1 connected to the indoor unit 1*b* and a second refrigerant flow path Pa2 connected to the external indoor unit 1*c*.

On the first refrigerant flow path Pa1, the expansion valve 190 for adjusting a flow rate of a refrigerant that is transferred to the indoor unit 1*b* may be provided, and on the second refrigerant flow path Pa2, an external expansion valve 195 for adjusting a flow rate of a refrigerant that is transferred to the external indoor unit 1*c* may be provided.

In a case in which a heating process is performed during a drying process for the indoor unit 1*b*, the outdoor heat exchanger 32 of the outdoor unit 1*a* may operate as an evaporator, and the heat exchanger 30 of the indoor unit 1*b* and the external heat exchanger 37 of the external indoor unit 1*c* may operate as condensers, according to switching of the 4-way valve 180.

Accordingly, the external indoor unit 1*a* may discharge hot air by operating as a condenser unintentionally during the drying process for the indoor unit 1*b*.

The controller 150 according to an embodiment may stop a blower fan 167 of the external indoor unit 1*c* upon performing of a heating process during the drying process for the indoor unit 1*b*. Thereby, the air conditioner 1 may prevent the external indoor unit 1*c* from discharging hot air unintentionally.

Also, the controller 150 according to an embodiment may open the external expansion valve 195 of the second refrigerant flow path Pa2 connected to the external indoor unit 1*c* by a preset ratio (for example, 15%), upon performing of the heating process during the drying process of the indoor unit 1*b*. Thereby, because a refrigerant enters the external indoor unit 1*c* during the drying process for the indoor unit 1*b*, the external indoor unit 1*c* may be prevented from breaking down.

Hereinafter, a method for controlling the air conditioner 1 according to an embodiment will be described. The air conditioner 1 according to the above-described embodiment may be applied to the method for controlling the air conditioner 1, which will be described below. Accordingly, content described above with reference to FIGS. 1 to 15 will be applied in the same way to the method for controlling the air conditioner 1 according to an embodiment, unless otherwise noted.

Figure 16:
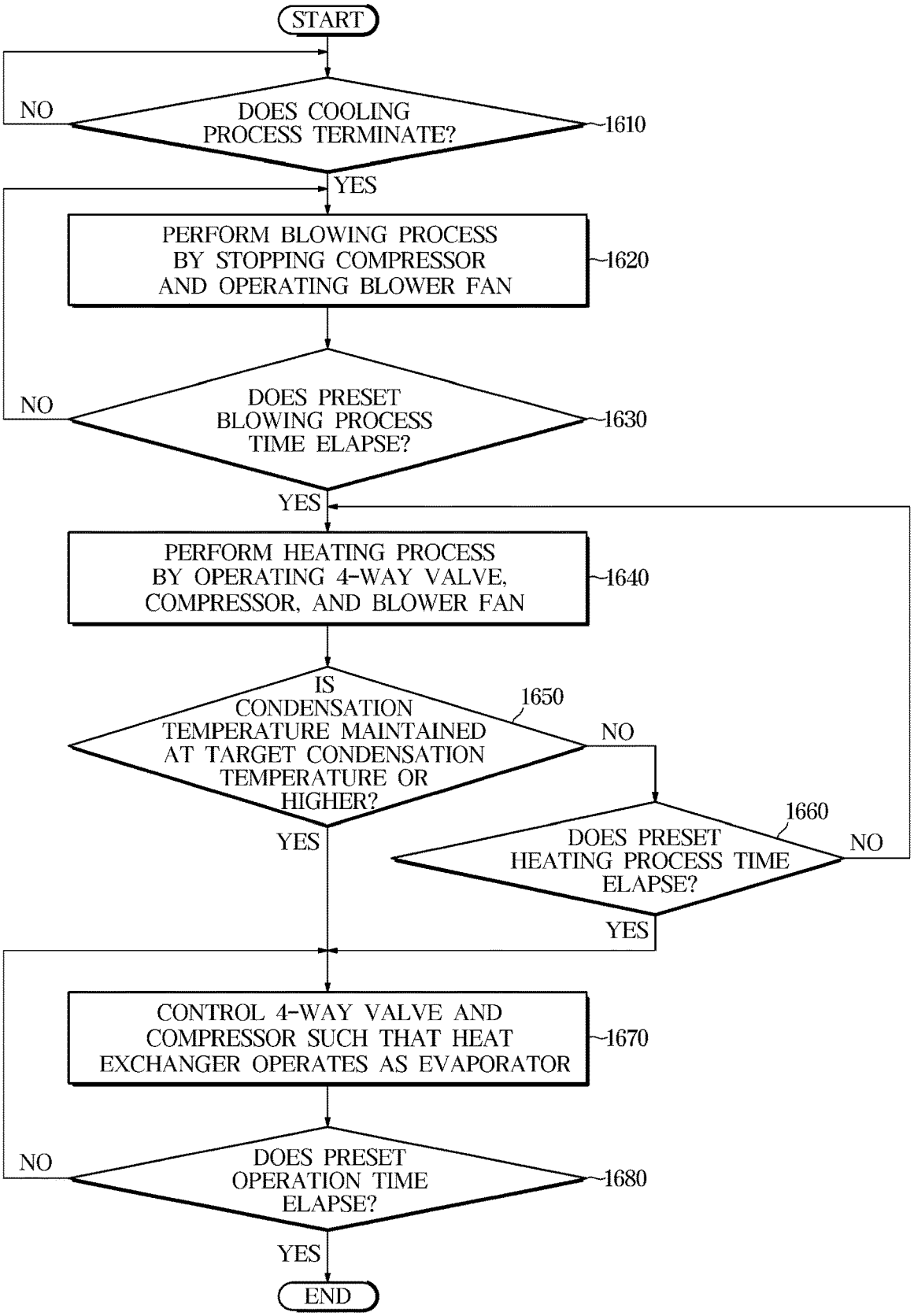
FIG. 16 is a flowchart showing a case of performing a drying process after a cooling process terminates in a method for controlling an air conditioner according to an embodiment.

FIG. 16 is a flowchart showing a case of performing a drying process after a cooling process terminates in a method for controlling the air conditioner 1 according to an embodiment.

Referring to FIG. 16, during a cooling process, the heat exchanger 30 may be cooled by a refrigerant, and as a result of contacting of air sucked through the first inlet 12 with the cooled heat exchanger 30, water may be condensed on the surface of the heat exchanger 30. Because the blower fan 160 blows air during the cooling process, the water condensed on the surface of the heat exchanger 30 may be collected in the drain container provided below the heat exchanger 30 by the blown air.

In a case in which the blower fan 160 stops after the cooling process terminates, water condensed on the heat exchanger 30 may be no longer removed. Water condensed on the first inlet 12, the main outlet 17, and the outlet panel 40, as well as the heat exchanger 30, may also be no longer removed. Due to the water, microbes may propagate on the heat exchanger 30, the first inlet 12, the main outlet 17, the outlet panel 40, and accordingly, stain may be generated and an odor may be created.

To prevent these, the air conditioner 1 may perform a drying process for drying condensed water on the surface of the heat exchanger 30 after the cooling process terminates.

The drying process may include a blowing process of operating the blower fan 160 in a state of stopping the compressor 170, and a heating process of changing a circulating direction of a refrigerant with the 4-way valve 180 while operating both the compressor 170 and the blower fan 160.

After the cooling process terminates (YES in 1610), the air conditioner 1 according to an embodiment may perform a blowing process by stopping the compressor 170 and operating the blower fan 160 (1620).

The controller 150 may dry the condensed water on the surface of the heat exchanger 30 by turning on only the blower fan 160 in a state of turning off the compressor 170 for a preset blowing process time (for example, 30 minutes) to blow air to the heat exchanger 30.

That is, the controller 150 may turn off the compressor 170, the outdoor blower fan (not shown), the 4-way valve 180, and the expansion valve 190, during the blowing process, such that refrigerant circulation stops and thus no heat exchange occurs in the heat exchanger 30.

At the same time, the controller 150 may operate the blower fan 160 such that outside air of the housing 10 enters the inside of the housing 10 through the first inlet 12, passes through the heat exchanger 30, passes through the plurality of holes of the outlet panel 40 to be reduced in speed, and then is discharged to the outside of the housing 10.

As such, because outside air passes through the heat exchanger 30 by the blowing process, condensed water condensed on the surface of the heat exchanger 30 by the cooling process may be dried. Also, water condensed on the inside of the indoor unit 1*b*, such as the first inlet 12, the main outlet 17, the outlet panel 40, etc., as well as the heat exchanger 30, may also be removed.

However, in a case in which room air has high humidity, there may be difficulties in reducing internal humidity of the heat exchanger 30 and the indoor unit 1*b* to lower humidity than humidity of the room air through the blowing process. As a result, there may be difficulties in completely removing condensed water on the heat exchanger 30 and inside the indoor unit 1*b* by the blowing process.

Accordingly, the air conditioner 1 according to an embodiment may operate the 4-way valve 180, the compressor 170, and the blower fan 160 according to an elapse of a preset blowing process time (YES in 1630) to perform a heating process (1640).

At this time, the air conditioner 1 may perform the heating process until condensation temperature is maintained at target condensation temperature or higher (YES in 1650) or until a preset heating process time elapses (YES in 1660) although the condensation temperature does not reach the target condensation temperature (NO in 1650).

That is, the controller 150 may turn on the 4-way vale 180 to change a circulating direction of the refrigerant and then turn on the blower fan 160 and the compressor 170 for a preset heating process time (for example, 10 minutes) such that the refrigerant is condensed in the heat exchanger 30 and heat is transferred to the condensed water on the surface of the heat exchanger 30. Thereby, the condensed water on the surface of the heat exchanger 30 may be completely dried. The heating process time may be set to a shorter time than the blowing process time.

At this time, the controller 150 may terminate the heating process according to an identification that a preset heating process time $T_1$ elapses after the heating process starts or that condensation temperature in the heat exchanger 30 is higher than or equal to target condensation temperature ($T_2$) after the heating process starts. For example, the controller 150 may terminate the heating process according to an identification that condensation temperature of a refrigerant is maintained for a preset time at the target condensation temperature. Thereby, the air conditioner 1 may prevent room temperature from rising excessively due to an excessive heating process.

Internal humidity of the indoor unit 1*b* may be low in a case in which a heating process is performed, compared to a case in which a drying process is not performed or a case in which only a blowing process is performed without performing a heating process, as shown in FIG. 9.

Through the drying process, internal humidity of the indoor unit 1*b* may become lower than room humidity, and condensed water may be more actively evaporated. The controller 150 may completely dry the condensed water on the surface of the heat exchanger 30 by operating the blower fan 160 in a state in which internal humidity of the indoor unit 1*b* becomes low due to heat of the heat exchanger 30.

Also, by the low internal humidity of the indoor unit 1*b* and blowing of air heat-exchanged in the heat exchanger 30, water condensed on the inside of the indoor unit 1*b*, such as the first inlet 12, the main outlet 17, the outlet panel 40, etc., as well as the heat exchanger 30, may also be completely removed.

Also, the air conditioner 1 may operate in the first mode during the drying process for drying condensed water on the surface of the heat exchanger 30. That is, during the drying process, the guide blower fan 165 may stop, and blowing of air through the guide flow paths S2 and S3 may be limited.

Thereby, air heat-exchanged by the heating process may be discharged to an indoor space only through the plurality of holes of the outlet panel 40. Accordingly, a less amount of heat may diffuse to the indoor space than in a case in which air is discharged through the guide outlets 13 and 14, and the drying process may be performed with low noise. Therefore, a user may be prevented from feeling uncomfortable due to rising room temperature by the drying process.

Meanwhile, according to another embodiment, in a case in which the indoor unit 1*b* further includes at least one outlet positioned in the portion of the front panel 16 in which the main outlet 17 is formed, and a door for opening or closing the outlet, the controller 150 may operate the blower fan 160 while controlling the door to close the outlet, to discharge air only through the plurality of holes during the drying process. That is, the indoor unit 1*b* may change a flow path of air entered the first inlet 12 by closing the outlet exposed to the outside of the housing 10 such that the air is reduced in speed and discharged through the plurality of holes of the outlet panel 40.

Meanwhile, according to another embodiment, in a case in which the indoor unit 1*b* does not include the outlet panel 40 and the main outlet 17 is exposed to the outside of the housing 10, the air conditioner 1 may perform the drying process by moving air through the main outlet 17. That is, the air conditioner 1 may perform the drying process by controlling the blower fan 160 and the compressor 170, and cause air entered the first inlet 12 to pass through the heat exchanger 30 and be discharged to the indoor space through the main outlet 17. Thereby, the air conditioner 1 may dry condensed water of the heat exchanger 30.

Also, in the case in which condensation temperature is maintained at target condensation temperature or higher (YES in 1650) or in the case in which a preset heating process time elapses (YES in 1660), the air conditioner 1 according to an embodiment may control the 4-way valve 180 and the compressor 170 such that the heat exchanger 30 operates as an evaporator (1670).

The air conditioner 1 may control the 4-way valve 180 and the compressor 170 such that the heat exchanger 30 operates as an evaporator until a preset operation time elapses (NO in 1680), and according to an elapse of the preset operation time (YES in 1680), the air conditioner 1 may terminate the drying process.

After a heating process terminates, the controller 150 may operate the compressor 170 for a preset operation time $T_3$ (for example, 30 seconds) such that a refrigerant is evaporated in the heat exchanger 30. The operation time $T_3$ may be set to a shorter time than the heating process time.

That is, the controller 150 may turn on the compressor 170, the outdoor blower fan, the 4-way valve 180, and the expansion valve 190 such that the heat exchanger 30 operates as an evaporator for the preset operation time $T_3$. However, the controller 150 may turn off the blower fan 160 to prevent heat from diffusing to a space to be air-conditioned for the preset operation time $T_3$.

Thereby, the heat exchanger 30 may be cooled, and heat of the heat exchanger 30, generated by the heating process, may be removed to prevent heat from diffusing to the space to be air-conditioned after the heating process. Accordingly, a user may be prevented from feeling uncomfortable due to rising room temperature by the drying process.

Also, according to an embodiment, the controller 150 may stop the compressor 170 after the heating process terminates, and according to an elapse of a preset switching time $T_4$ after the heating process terminates, the controller 150 may turn off the 4-way valve to change a circulating direction of a refrigerant to the circulating direction for the cooling process, and operate the compressor 170 for the preset operation time $T_3$ after the 4-way valve 180 is turned off.

As such, according to an embodiment, the air conditioner 1 may stop the compressor 170 for the switching time $T_4$ after the heating process terminates to maintain pressure of the refrigerant at pressure equilibrium, and then switch the 4-way valve 180, thereby preventing noise that is generated upon switching of the 4-way valve 180.

Figure 17:
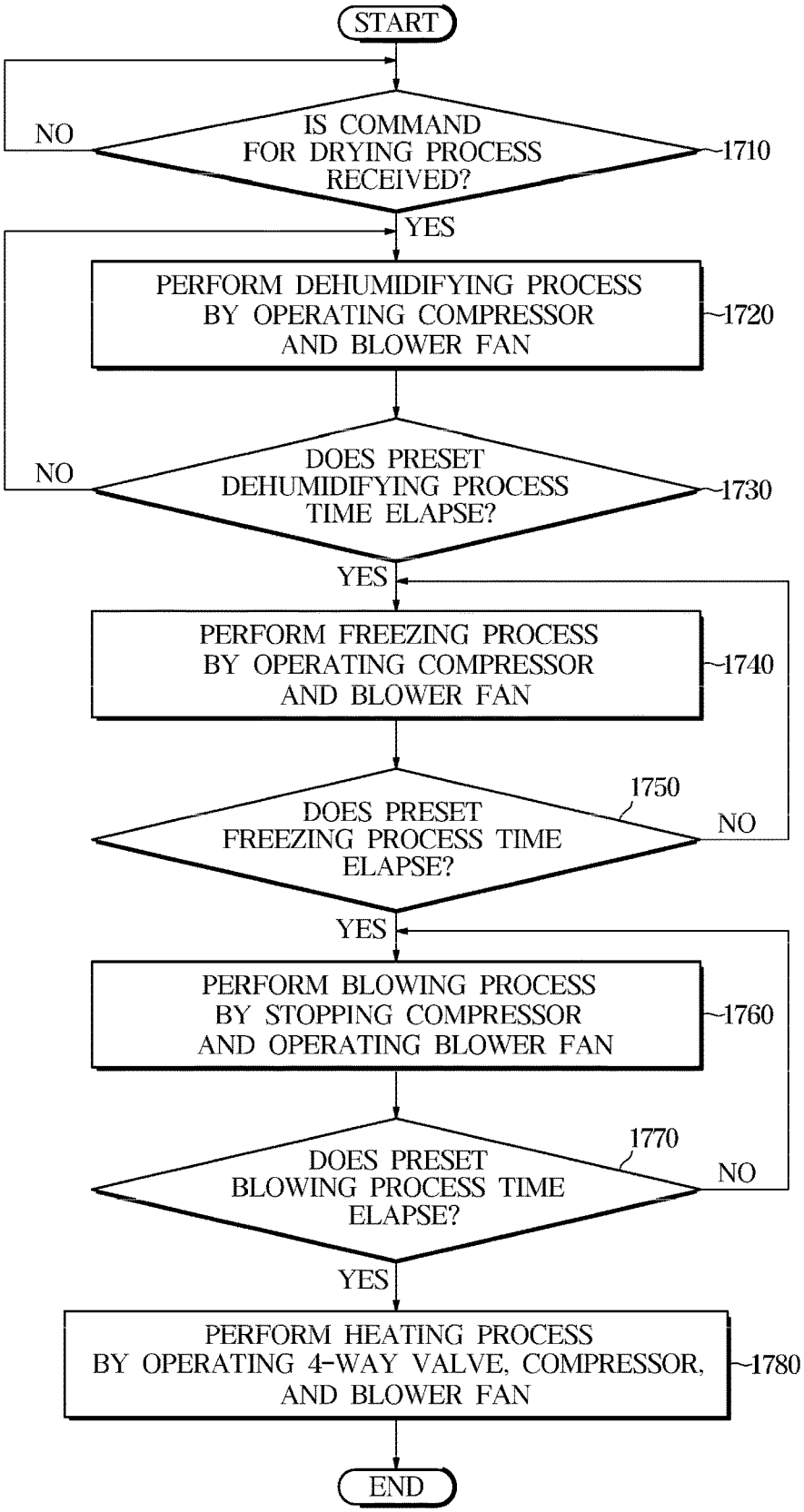
FIG. 17 is a flowchart showing a case of performing a drying process according to a user input in a method for controlling an air conditioner according to an embodiment.

FIG. 17 is a flowchart showing a case of performing a drying process according to a user input in a method for controlling the air conditioner 1 according to an embodiment.

Referring to FIG. 17, upon reception of a command for a drying process from a user through the inputter 110, the air conditioner 1 according to an embodiment may perform a dehumidifying process and a freezing process sequentially by controlling the blower fan 160 and the compressor 170, and after the freezing process terminates, the air conditioner 1 may perform a blowing process and a heating process sequentially by controlling the blower fan 160 and the compressor 170.

That is, in a case in which the controller 150 performs a drying process by receiving a command for a drying process through the inputter 110, compared to a case of performing a drying process after a cooling process terminates, the controller 150 may preferentially perform a dehumidifying process and a freezing process before a blowing process and a heating process. As such, the controller 150 may forcedly generate condensed water on the surface of the heat exchanger 30 by preferentially performing the dehumidifying process and the freezing process, and then perform the blowing process and the heating process sequentially.

More specifically, upon reception of a command for a drying process (YES in 1710), the air conditioner 1 may perform a dehumidifying process by operating the compressor 170 and the blower fan 160 (1720).

The controller 150 may operate the blower fan 160, the compressor 170, the outdoor blower fan, and the expansion valve 190 for a preset dehumidifying process time (for example, 15 minutes) such that the heat exchanger 30 operates as an evaporator. At this time, as the heat exchanger 30 is cooled, condensed water may be generated on the surface of the heat exchanger 30.

According to an elapse of the preset dehumidifying process time (YES in 1730), the air conditioner 1 may perform a freezing process by operating the compressor 170 and the blower fan 160 (1740).

After the dehumidifying process terminates, the controller 150 may operate the blower fan 160 and the compressor 170 for a preset freezing process time (for example, 15 minutes) to freeze the heat exchanger 30. That is, the controller 150 may operate the blower fan 160, the compressor 170, the outdoor blower fan, and the expansion valve 190 such that the heat exchanger 30 operates as an evaporator.

More specifically, the controller 150 may adjust target evaporation temperature of a refrigerant in the heat exchanger 30 to lower temperature to lower temperature of the surface of the heat exchanger 30 to a freezing point such that condensed water on the surface of the heat exchanger 30 is frozen as ice capsules.

Also, the controller 150 may adjust at least one of rpm of the blower fan 160, an operating frequency of the compressor 170, or a degree of opening of the expansion valve 190 such that the refrigerant is evaporated at the target evaporation temperature.

As such, while the air conditioner 1 performs the freezing process, the condensed water on the surface of the heat exchanger 30 may be frozen, and contaminants, such as dust, foreign materials, etc., existing on the surface of the heat exchanger 30 may be detached from the surface of the heat exchanger 30 by the frozen, condensed water.

According to an elapse of the preset freezing process time (YES in 1750), the air conditioner 1 may perform a blowing process by stopping the compressor 170 and operating the blower fan 160 (1760).

After the freezing process terminates, the controller 150 may perform the blowing process of blowing air to the heat exchanger 30 by operating the blower fan 150 in a state of stopping the compressor 170. Through the blowing process, the frozen, condensed water may melt, and the contaminants may be naturally discharged from the heat exchanger 30 together with the melt, condensed water.

According to an elapse of the preset blowing process time (YES in 1770), the air conditioner 1 may perform a heating process by operating the 4-way valve 180, the compressor 170, and the blower fan 160 (1780).

After the blowing process terminates, the controller 150 may perform the heating process by controlling the blower fan 160 and the compressor 170. At this time, according to an embodiment, the controller 150 may adjust target condensation temperature to higher temperature to supply higher heat to the heat exchanger 30 than in a drying process that is performed according to termination of a cooling process.

As such, the air conditioner 1 may perform the blowing process and the heating process sequentially after a freezing process to dry the condensed water while removing the contaminants from the heat exchanger 30.

Also, like a case in which a drying process is performed after a cooling process terminates, the controller 150 may operate the compressor 170 for a preset operation time $T_3$ (for example, 30 seconds) after the heating process terminates such that a refrigerant is evaporated in the heat exchanger 30 (cooling saturation).

However, according to an embodiment, upon reception of a command for a drying process from a user through the inputter 110, the air conditioner 1 may perform a dehumidifying process, a blowing process, and a heating process sequentially without performing a freezing process. That is, the controller 150 may perform the blowing process and the heating process sequentially without performing the freezing process, after the dehumidifying process terminates.

In other words, upon reception of a command for a drying process from a user through the inputter 110, the drying process may include a dehumidifying process, a freezing process, a blowing process, and a heating process, or the drying process may include a dehumidifying process, a blowing process, and a heating process, according to embodiments.

The controller 150 may operate only the blower fan 160 and stop the guide blower fan 165 to discharge air only through the plurality of holes during the drying process. That is, the controller 150 may perform a control operation of supplying power only to the fan motor corresponding to the blower fan 160 while blocking power to be supplied to the fan motor corresponding to the guide blower fan 165.

Meanwhile, according to another embodiment, in a case in which the indoor unit 1*b* further includes at least one outlet positioned in the portion of the front panel 16 in which the main outlet 17 is formed, and a door for opening or closing the outlet, the controller 150 may operate the blower fan 160 while controlling the door to close the outlet, during the drying process, to discharge air only through the plurality of holes. That is, the indoor unit 1*b* may change a flow path of air entered the first inlet 12 by closing the outlet exposed to the outside of the housing 10 such that the air is reduced in speed and discharged through the plurality of holes of the outlet panel 40.

However, according to an embodiment, the indoor unit 1*b* may perform the drying process in a state of opening the outlet. More specifically, according to an embodiment, upon reception of a command for a drying process from a user through the inputter 110, the controller 150 may perform the drying process in a state of controlling the door actuator to open the outlet.

Meanwhile, according to another embodiment, in a case in which the indoor unit 1*b* does not include the outlet panel 40 and the main outlet 17 is exposed to the outside of the housing 10, the air conditioner 1 may perform a drying process by moving air through the main outlet 17. That is, the air conditioner 1 may perform a drying process by controlling the blower fan 160 and the compressor 170 such that air entered the first inlet 12 passes through the heat exchanger 30 and is discharged to an indoor space through the main outlet 17. Thereby, the air conditioner 1 may dry condensed water of the heat exchanger 30.

Figure 18:
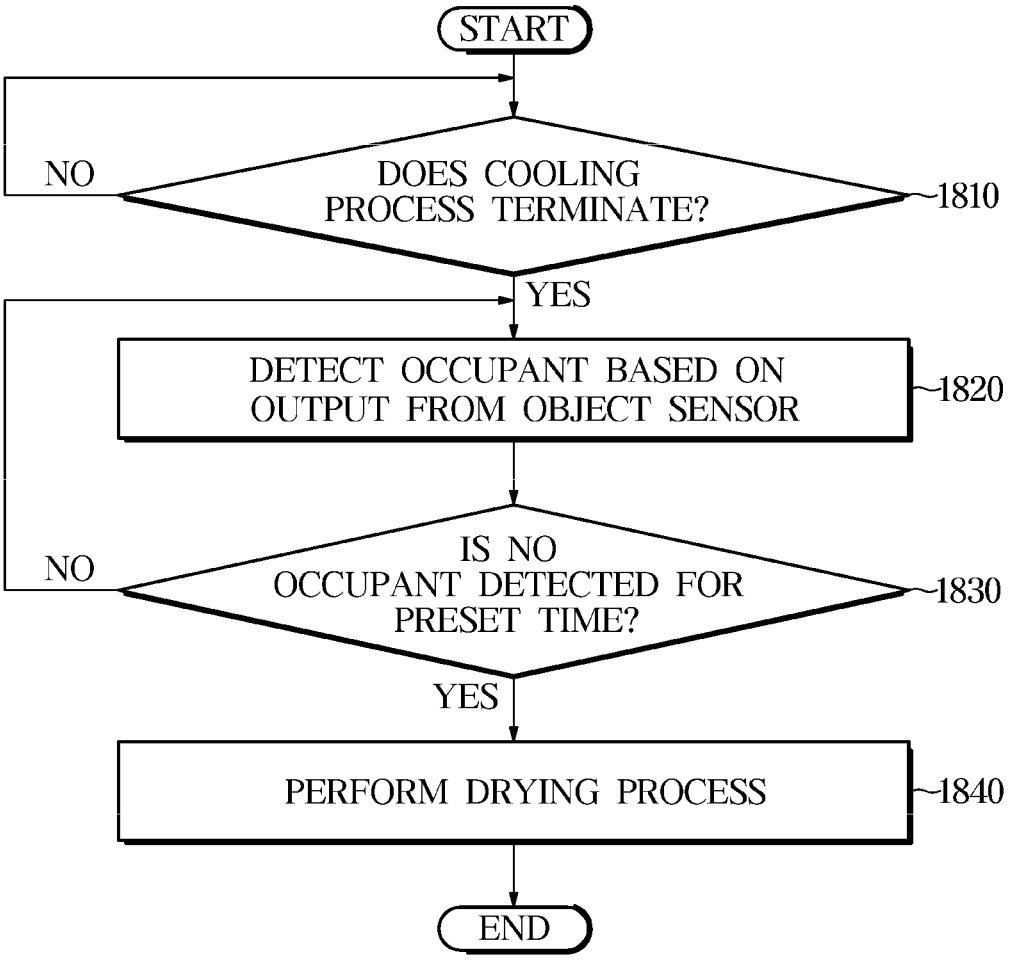
FIG. 18 is a flowchart showing a case of identifying whether an occupant exists according to an output from an object sensor and performing a drying process in a method for controlling an air conditioner according to an embodiment.

FIG. 18 is a flowchart showing a case of identifying whether an occupant exists according to an output from the object sensor 135 and performing a drying process in a method for controlling the air conditioner 1 according to an embodiment.

Referring to FIG. 18, upon termination of the cooling process (YES in 1810), the air conditioner 1 according to an embodiment may detect an occupant U based on an output from the object sensor 135 (1820), and, in a case in which no occupant U is detected from a preset time (YES in 1830), the air conditioner 1 may perform a drying process (1840).

In a case in which it is identified that no occupant U exists in a space H to be air-conditioned based on the output from the object sensor 135, the controller 150 may perform the drying process by controlling the blower fan 160 and the compressor 170.

According to an embodiment, in a case in which no occupant U is detected for a preset time (for example, 30 minutes) through the object sensor 135, the controller 150 may identify that no occupant U exists in the space H to be air-conditioned.

For example, only in the case in which it is identified that no occupant U exists in the space H to be air-conditioned based on an output from the object sensor 135 after a cooling process terminates, the controller 150 may perform a blowing process and a heating process sequentially by controlling the blower fan 160 and the compressor 170.

Figure 19:
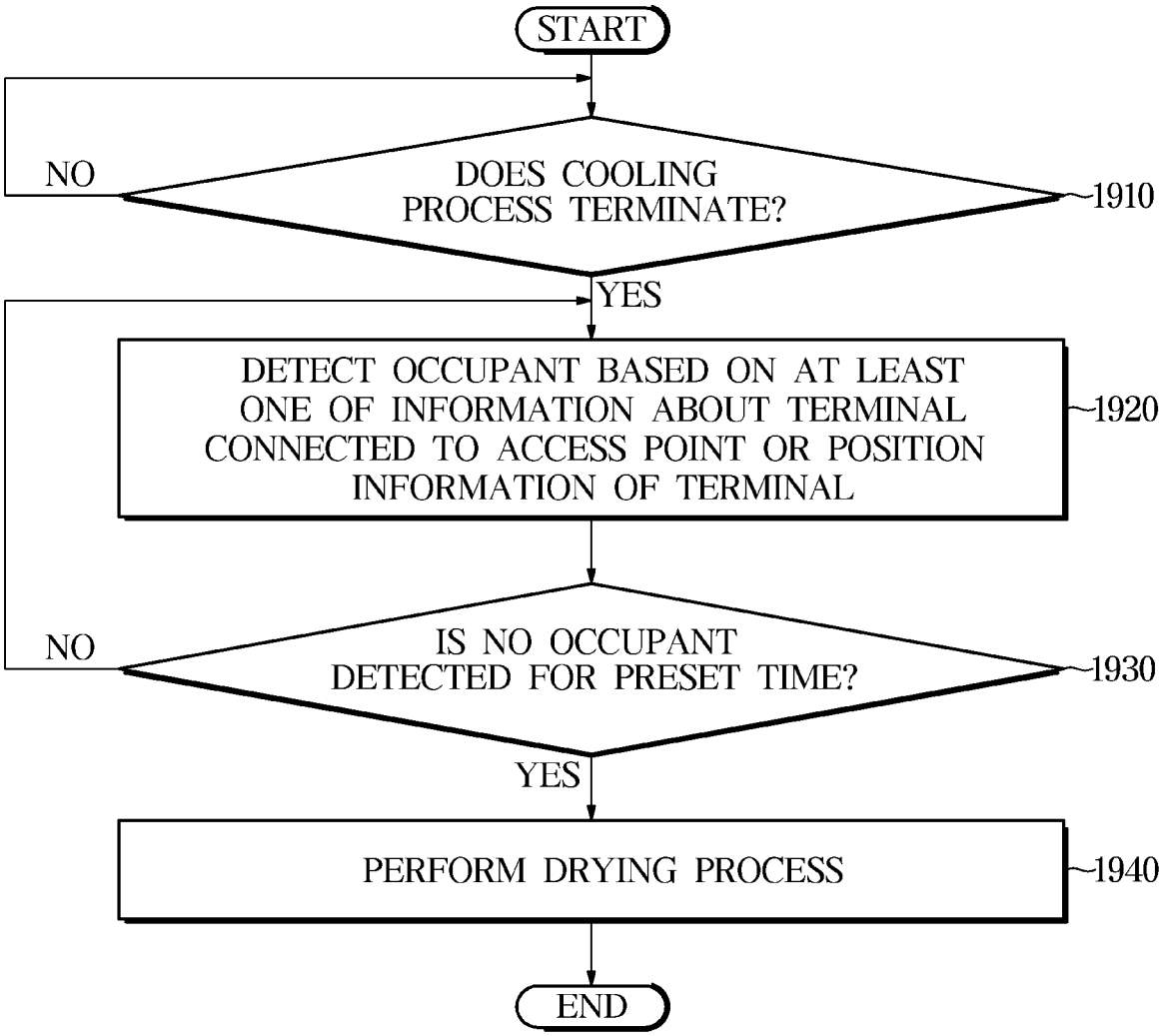
FIG. 19 is a flowchart showing a case of identifying whether an occupant exists according to a location of a terminal and performing a drying process in a method for controlling an air conditioner according to an embodiment.

FIG. 19 is a flowchart showing a case of identifying whether an occupant exists according to a location of the terminal 400 and performing a drying process in a method for controlling the air conditioner 1 according to an embodiment.

As such, by performing a drying process in a case in which no occupant U exists in the space H to be air-conditioned, the air conditioner 1 may prevent a user from feeling uncomfortable due to changes in temperature and humidity of the space H to be air-conditioned according to the drying process.

Referring to FIG. 19, upon termination of the cooling process (YES in 1910), the air conditioner 1 according to an embodiment may detect an occupant U based on at least one of information about the terminal 400 connected to the access point 300 or position information of the terminal 400 (1920), and in a case in which no occupant U is detected for a preset time (YES in 1930), the air conditioner 1 may perform a drying process (1940).

The controller 150 may receive information about the terminal 400 connected to the access point 300 from the access point 300 through the communicator 120. The information about terminal 400 connected to the access point 300 may include identification information of the terminal 400 located in the space H to be air-conditioned and connected to the access point 300. The controller 150 may identify that no occupant U exists in a space H to be air-conditioned, in a case in which the information about the terminal 400 connected to the access point 300 indicates that there is no terminal 400 connected to the access point 300.

Also, the controller 150 may receive position information (for example, a global positioning system (GPS) signal) of the terminal 400 from the terminal 400 through the communicator 120. That is, the controller 150 may receive position information of the terminal 400 from the terminal 400 connected to the network through a separate communication service, and identify that no occupant U exists in the space H to be air-conditioned, in a case in which the position information of the terminal 400 indicates that the terminal 400 is positioned outside the space H to be air-conditioned.

For example, only in the case in which the information of the terminal 400 connected to the access point 300 indicates that there is no terminal 400 connected to the access point 300 after the cooling process terminates or in the case in which the position information of the terminal 400 indicates the outside of the space H to be air-conditioned, the controller 150 may perform a blowing process and a heating process sequentially by controlling the blower fan 160 and the compressor 170.

As such, by performing a drying process in a case in which no occupant U exists in the space H to be air-conditioned, the air conditioner 1 may prevent a user from feeling uncomfortable due to changes in temperature and humidity of the space H to be air-conditioned according to the drying process.

Figure 20:
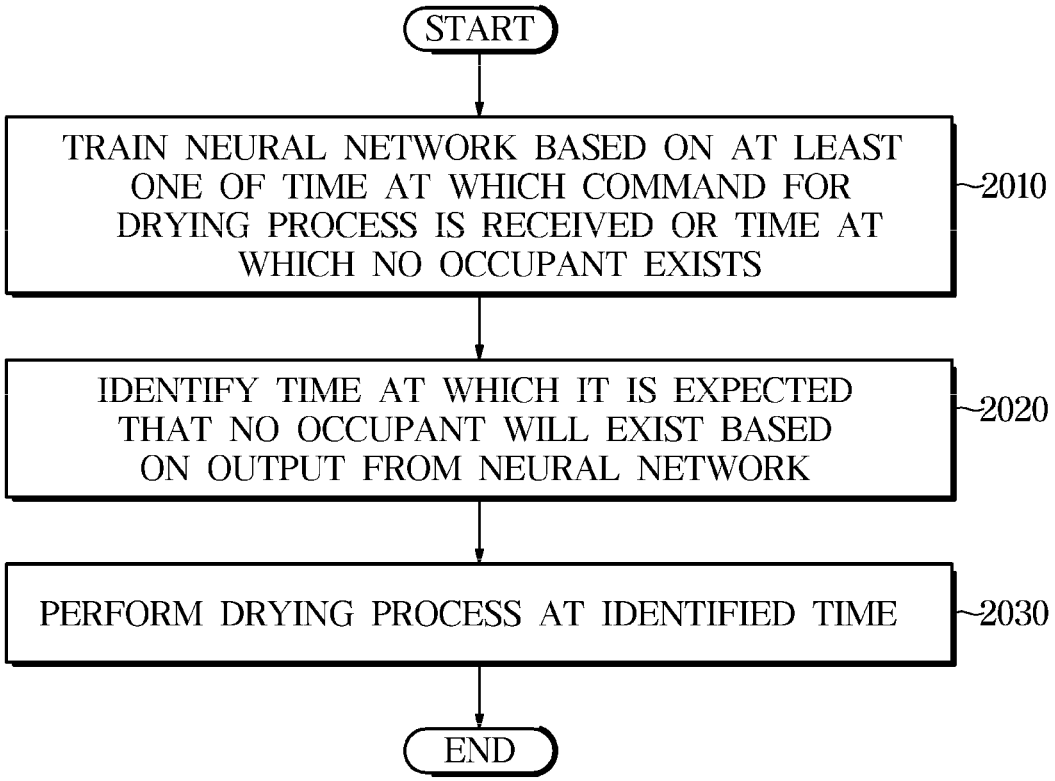
FIG. 20 is a flowchart showing a case of performing a drying process based on an output from a trained neural network in a method for controlling an air conditioner according to an embodiment.

FIG. 20 is a flowchart showing a case of performing a drying process based on an output from a trained neural network in a method for controlling the air conditioner 1 according to an embodiment.

Referring to FIG. 20, the air conditioner 1 according to an embodiment may train a neural network based on at least one of a time at which a command for a drying process is received or a time at which no occupant exists (2010), identify a time at which it is expected that no occupant U will exist based on an output from the neural network (2020), and perform a drying process at the identified time (2030).

For this, the controller 150 may train the neural network by using at least one of a time at which a command for a drying process is received or a time at which it is identified that no occupant exists.

More specifically, the controller 150 may transfer a time at which a command for a drying process is received to the neural network. Also, the controller 150 may transfer a time at which it is identified that no occupant U exists in the space H to be air-conditioned, based on an output from the objector sensor 135, to the neural network. Also, the controller 150 may transfer a time at which it is identified that no occupant U exists in the space H to be air-conditioned based on at least one of information about the terminal 400 connected to the access point or position information of the terminal 400, to the neural network.

The controller 150 may identify a time at which it is expected that no occupant will exist, based on an output (neural network output information) from the neural network, and perform a drying process by controlling the blower fan 160 and the compressor 170 at the identified time.

For example, the controller 170 may perform a blowing process and a heating process sequentially by controlling the blower fan 160 and the compressor 170 only at the time at which it is expected that no occupant will exist, based on an output (neural network output information) from the neural network, even after a cooling process terminates.

Also, the controller 150 may perform a dehumidifying process, a freezing process, a blowing process, and a heating process sequentially by controlling the blower fan 160 and the compressor 170 at the time at which it is expected that no occupant will exist, based on an output (neural network output information) from the neural network, even in a case in which no cooling process is performed.

Meanwhile, the disclosed embodiments may be implemented in the form of a recording medium that stores instructions executable by a computer. The instructions may be stored in the form of a program code, and when executed by a processor, the instructions may create a program module to perform operations of the disclosed embodiments. The recording medium may be implemented as a computer-readable recording medium.

The computer-readable recording medium may include all kinds of recording media storing instructions that can be interpreted by a computer. For example, the recording media may include Read Only Memory (ROM), Random Access Memory (RAM), a magnetic tape, a magnetic disc, flash memory, an optical data storage device, etc.

So far, the disclosed embodiments have been described with reference to the accompanying drawings. It will be apparent to one of ordinary skill in the technical field to which the present disclosure belongs that the present disclosure may be practiced in different forms from the disclosed embodiments without changing the technical spirit and essential features of the disclosure. Thus, it should be understood that the disclosed embodiments are merely for illustrative purposes and not for limitation purposes.

What is claimed is:

1. An air conditioner comprising:

a heat exchanger;

a blower fan;

a compressor;

an inputter configured to receive a command;

a communicator configured to communicate with an access point (AP) and a terminal; and a controller configured to:

perform a cooling process in which the compressor is operated to compress a circulating refrigerant, the heat exchanger performs heat exchange between the refrigerant and air, and the blower fan is operated to blow air to the heat exchanger, thereby cooling a space; and after termination of the cooling process, perform a drying process to dry water condensed on a surface of the heat exchanger and not removed during the cooling process, the drying process including:

performing a dehumidifying process in which the compressor is operated to compress the circulating refrigerant, the heat exchanger performs heat exchange between the refrigerant and air, and the blower fan is operated to blow air to the heat exchanger, after the dehumidifying process terminates, performing, for a first predetermined time, a blowing process in which the blower fan is operated to blow air to the heat exchanger while the compressor is stopped, and after the first predetermined time, performing a heating process in which the refrigerant is circulated in a direction that is changed from that of the cooling process, the blower fan is operated to blow air to the heat exchanger, and the compressor is operated to compress the refrigerant, wherein the controller is further configured to:

identify a time at which it is expected that no occupant will be in the space based on an output from a trained neural network that is trained using at least one of:

a time at which a command for initiating the drying process is received from a user through the inputter, and a time at which it is identified that no occupant is in the space based on information received from the communicator, and perform the drying process at the identified time.

2. The air conditioner of claim 1, further comprising:

a temperature sensor configured to detect a condensation temperature of the refrigerant, wherein the controller is further configured to terminate the heating process in a case in which a preset time elapses after the heating process starts or in a case in which the condensation temperature is higher than or equal to a target condensation temperature.

3. The air conditioner of claim 2, wherein the controller is further configured to:

after the dehumidifying process terminates and before the drying process begins, perform a freezing process in which the compressor is operated to compress the circulating refrigerant, the heat exchanger performs heat exchange between the refrigerant and air, the blower fan is operated to blow air to the heat exchanger, and a target evaporation temperature of the refrigerant is lowered.

4. The air conditioner of claim 2, wherein the drying process includes raising the target condensation temperature before the heating process.

5. The air conditioner of claim 1, wherein the controller is further configured to:

terminate the heating process; and after the heating process terminates, operate the compressor for a second predetermined time, thereby evaporating the refrigerant in the heat exchanger.

6. The air conditioner of claim 5, wherein the compressor is operated for the second predetermined time after elapse of a third predetermined time after the heating process terminates, the air conditioner further comprising:

a 4-way valve configured to change a circulating direction of the refrigerant, wherein the controller is further configured to:

after elapse of the third predetermined time, operate the 4-way valve to change the circulating direction of the refrigerant to that of the cooling process.

7. The air conditioner of claim 1, further comprising:

a sensor configured to detect whether an occupant is in the space, wherein the controller is further configured to perform the drying process based on a detection from the sensor that there is no occupant in the space.

8. The air conditioner of claim 1, wherein the heat exchanger and the blower fan are comprised in an indoor unit, the air conditioner further comprising:

at least a first indoor unit and a second indoor unit, wherein the controller is further configured to independently control the blower fan of each indoor unit such that during the heating process, the controller stops the blower fan of the first indoor unit while the controller operates the blower fan of at least the second indoor unit.

9. The air conditioner of claim 8, further comprising:

an expansion valve configured to control an opening of a refrigerant flow path, wherein the controller is further configured to open the expansion valve of a refrigerant flow path connected to the first indoor unit by a preset ratio during the heating process.

10. The air conditioner of claim 1, further comprising:

an outlet; and an outlet panel on a front surface of the outlet, the outlet panel including a plurality of holes, wherein the controller is further configured to perform a control operation of discharging air through the plurality of holes during the drying process.

11. A method for controlling an air conditioner, the air conditioner including a heat exchanger, a blower fan, a compressor, an inputter configured to receive a command, a communicator configured to communicate with an access point (AP) and a terminal, and a controller, the method comprising, by the controller:

performing a cooling process in which the compressor is operated to compress a circulating refrigerant, the heat exchanger performs heat exchange between the refrigerant and air, and the blower fan is operated to blow air to the heat exchanger, thereby cooling a space; and after termination of the cooling process, performing a drying process to dry water condensed on a surface of the heat exchanger and not removed during the cooling process, the drying process including:

performing a dehumidifying process in which the compressor is operated to compress the circulating refrigerant, the heat exchanger performs heat exchange between the refrigerant and air, and the blower fan is operated to blow air to the heat exchanger, after the dehumidifying process terminates, performing, for a predetermined time, a blowing process in which the blower fan is operated to blow air to the heat exchanger while the compressor is stopped, and after the predetermined time, performing a heating process in which the refrigerant is circulated in a direction that is changed from that of the cooling process, the blower fan is operated to blow air to the heat exchanger, and the compressor is operated to compress the refrigerant, the method further comprising:

identifying a time at which it is expected that no occupant will be in the space based on an output from a trained neural network that is trained using at least one of:

a time at which a command for initiating the drying process is received from a user through the inputter, and a time at which it is identified that no occupant is in the space based on information received from the communicator, and performing the drying process at the identified time.

12. The method of claim 11, wherein the air conditioner further comprises a temperature sensor configured to detect a condensation temperature of the refrigerant, the method further comprising, by the controller:

terminating the heating process in a case in which a first time elapses after the heating process starts, or in a case in which the condensation temperature is detected to be higher than or equal to a target condensation temperature.

* * * * *